US011195652B2

(12) United States Patent
Cho et al.

(10) Patent No.: US 11,195,652 B2
(45) Date of Patent: Dec. 7, 2021

(54) COIL COMPONENT

(71) Applicant: SAMSUNG ELECTRO-MECHANICS CO., LTD., Suwon-si (KR)

(72) Inventors: Tai Yon Cho, Suwon-si (KR); Tae Jun Choi, Suwon-si (KR); Jung Young Cho, Suwon-si (KR); Chang Hak Choi, Suwon-si (KR); Byeong Cheol Moon, Suwon-si (KR); Seung Hee Oh, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 382 days.

(21) Appl. No.: 16/188,842

(22) Filed: Nov. 13, 2018

(65) Prior Publication Data

US 2019/0259526 A1 Aug. 22, 2019

(30) Foreign Application Priority Data

Feb. 22, 2018 (KR) ..... 10-2018-0021346
May 28, 2018 (KR) ..... 10-2018-0060195

(51) Int. Cl.
*H01F 27/36* (2006.01)
*H01F 27/28* (2006.01)
(Continued)

(52) U.S. Cl.
CPC ..... *H01F 27/2885* (2013.01); *H01F 17/0013* (2013.01); *H01F 27/2804* (2013.01);
(Continued)

(58) Field of Classification Search
CPC .. H01F 27/288; H01F 27/2885; H01F 27/346; H01F 27/36; H01F 27/361;
(Continued)

(56) References Cited

U.S. PATENT DOCUMENTS 10,600,560 B2 3/2020 Masuda et al.
10,854,383 B2 12/2020 Choi
(Continued)

FOREIGN PATENT DOCUMENTS

CN 104575938 A 4/2015
CN 105957692 A 9/2016
(Continued)

OTHER PUBLICATIONS

Office Action issued in corresponding Japanese Application No. 2018-210824, dated Mar. 5, 2019.
(Continued)

*Primary Examiner* — Tszfung J Chan
(74) *Attorney, Agent, or Firm* — Morgan, Lewis & Bockius LLP

(57) ABSTRACT

A coil component includes: a body having one surface and the other surface opposing each other in one direction; a coil portion including a coil pattern having at least one turn around the one direction, and embedded in the body; an external electrode disposed on the one surface of the body and connected to the coil portion; a shielding layer disposed on the other surface of the body; and an insulating layer disposed between the body and the shielding layer.

27 Claims, 14 Drawing Sheets

(51) Int. Cl.
*H01F 27/29* (2006.01)
*H01F 27/32* (2006.01)
*H01F 17/00* (2006.01)
*H01F 17/04* (2006.01)

(52) U.S. Cl.
CPC ..... *H01F 27/29* (2013.01); *H01F 27/32* (2013.01); *H01F 27/36* (2013.01); *H01F 2017/008* (2013.01); *H01F 2017/048* (2013.01); *H01F 2027/2809* (2013.01)

(58) Field of Classification Search
CPC ..... H01F 27/363; H01F 27/366; H01F 2017/008; H01F 27/2804; H01F 17/0006; H01F 17/0013; H01F 2017/0046; H01F 2017/0073; H01F 2027/2809; H01F 5/003; H01F 27/29; H01F 27/292; H01F 27/32
USPC ..... 336/84 R, 84 C, 84 M, 200, 232
See application file for complete search history.

(56) References Cited

U.S. PATENT DOCUMENTS

| | | | | |
|---|---|---|---|---|
| 2014/0177197 | A1* | 6/2014 | Lampinen | H05K 9/0075 361/818 |
| 2015/0028983 | A1 | 1/2015 | Ryu et al. | |
| 2015/0116950 | A1 | 4/2015 | Yoo et al. | |
| 2016/0268038 | A1 | 9/2016 | Choi | |
| 2016/0268040 | A1 | 9/2016 | Kim et al. | |
| 2017/0026019 | A1 | 1/2017 | Sim et al. | |
| 2017/0032884 | A1* | 2/2017 | Choi | H01F 17/0013 |
| 2017/0110240 | A1 | 4/2017 | Masuda et al. | |
| 2017/0200682 | A1* | 7/2017 | Lin | H01L 24/97 |
| 2017/0271081 | A1* | 9/2017 | Maki | H01F 27/02 |
| 2017/0309576 | A1* | 10/2017 | Kawabata | H01L 25/50 |
| 2018/0166211 | A1* | 6/2018 | Takatsuji | H01F 17/04 |
| 2018/0315545 | A1* | 11/2018 | Kusumoto | H01F 27/40 |
| 2019/0199310 | A1* | 6/2019 | Sato | H01F 17/0013 |

FOREIGN PATENT DOCUMENTS

| | | | | | |
|---|---|---|---|---|---|
| CN | 106373738 | A | | 2/2017 | |
| CN | 206301679 | U | | 7/2017 | |
| CN | 107017854 | A | | 8/2017 | |
| JP | 3-11 | U | | 1/1991 | |
| JP | 2005-310863 | A | | 11/2005 | |
| JP | 2005-353989 | A | | 12/2005 | |
| JP | 2009-99766 | A | | 5/2009 | |
| JP | 201 1-49421 | A | | 3/2011 | |
| JP | 2011-124373 | A | | 6/2011 | |
| JP | 4900186 | B2 | | 3/2012 | |
| JP | 2015-26812 | A | | 2/2015 | |
| JP | 2016-111280 | A | | 6/2016 | |
| JP | 2016-167578 | A | | 9/2016 | |
| JP | 2017-054891 | A | | 3/2017 | |
| JP | 2017-76796 | A | | 4/2017 | |
| JP | 2017076796 | A | * | 4/2017 | H01F 17/0013 |
| KR | 10-2015-0050306 | A | | 5/2015 | |
| KR | 10-2016-0100017 | A | | 8/2016 | |
| KR | 10-2016-0108935 | A | | 9/2016 | |

OTHER PUBLICATIONS

Office Action issued in corresponding Korean Application No. 10-2018-0060195, dated Jun. 27, 2019.
Office Action issued in corresponding Chinese Patent Application No. 201910114153.1 dated Dec. 23, 2020, with English translation.
Office Action issued in corresponding Chinese Patent Application No. 201910114153.1 dated Sep. 22, 2021, with English translation.

* cited by examiner

COIL COMPONENT

CROSS-REFERENCE TO RELATED APPLICATION(S)

This application claims benefit of priority to Korean Patent Application Nos. 10-2018-0021346 filed on Feb. 22, 2018 and 10-2018-0060195 filed on May 28, 2018 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used in an electronic device together with a resistor and a capacitor.

In accordance with gradual performance improvements and size decreases of electronic devices, the number of electronic components used in electronic devices has increased, and the sizes of the electronic components have been decreased.

For the reason described above, demand for removal of a noise generation source such as electromagnetic interference (EMI) of the electronic components has gradually increased.

In current general EMI shielding technology, electronic components are mounted on a board, and the electronic components and the board are then simultaneously surrounded by a shield can.

SUMMARY

An aspect of the present disclosure may provide a coil component in which a leaked magnetic flux may be decreased.

An aspect of the present disclosure may also provide a coil component in which a leaked magnetic flux may be decreased and characteristics of coil component may be substantially maintained.

According to an aspect of the present disclosure, a coil component may include: a body having one surface and the other surface opposing each other in one direction; a coil portion including a coil pattern having at least one turn around the one direction, and embedded in the body; an external electrode disposed on the one surface of the body and connected to the coil portion; a shielding layer disposed on the other surface of the body; and an insulating layer disposed between the body and the shielding layer.

A thickness of the shielding layer may be greater in a central portion of the other surface of the body than in an outer side portion of the other surface of the body.

The shielding layer may include: a cap portion disposed on the other surface of the body; and a sidewall portion connected to the cap portion and disposed on a wall of the body connecting the one surface of the body and the other surface of the body to each other.

The cap portion and the sidewall portion may be one integral piece.

A connection portion between the cap portion and the sidewall portion may have a curved surface shape.

The cap portion may have a thickness greater than that of the sidewall portion.

The number of walls of the body may be plural and the number of side portions is plural, and the plurality of sidewall portions may be disposed on the plurality of walls of the body, respectively.

The plurality of sidewall portions may be one integral piece.

The plurality of sidewall portions and the cap portion may be one integral piece.

The plurality of sidewall portions may include first and second sidewall portions disposed, respectively, on any one and another of the plurality of walls of the body, each of the first and second sidewall portions may have one end connected to the cap portion and the other end opposing the one end, and distances from the one surface of the body to the other ends of the first and second sidewall portions may be different from each other.

The number of coil patterns may be plural, and the plurality of coil patterns may be stacked in a direction from the one surface of the body toward the other surface of the body.

The coil component may further include an internal insulating layer, wherein the coil portion includes first and second coil patterns stacked in a direction toward the other surface of the body and a via connecting the first and second coil patterns to each other, and the internal insulating layer is disposed between the first and second coil patterns, and the via penetrates through the internal insulating layer.

The coil component may further include an insulating film formed along surfaces of the first coil pattern, the internal insulating layer, and the second coil pattern.

The shielding layer may include at least one of a conductor and a magnetic material.

The coil component may further include a cover layer disposed on the shielding layer to cover the shielding layer and in contact with the insulating layer.

The cover layer may close the shielding layer together with the insulating layer.

The cover layer may extend to the one surface of the body and have an opening, in which a penetration portion of the external electrode is disposed.

A sum of thicknesses of the insulating layer, the shielding layer, and the cover layer may be 30 nm or greater and 100 μm or less.

The shielding layer may include a first shielding layer disposed on the other surface of the body; and a second shielding layer disposed on the first shielding layer. The insulating layer may include a first insulating layer disposed between the first shielding layer and the body; and a second insulating layer disposed between the first shielding layer and the second shielding layer.

The first shielding layer may include a magnetic material, and the second shielding layer may include a conductor and be disposed on each of a plurality of walls of the body connecting the one surface of the body and the other surface of the body to each other.

The first shielding layer may include a conductor and be disposed on each of a plurality of walls of the body connecting the one surface of the body and the other surface of the body to each other, and the second shielding layer may include a magnetic material.

According to an aspect of the present disclosure, a coil component may include: a body having one surface and the other surface opposing each other in one direction and a wall connecting the one surface and the other surface to each other, and including magnetic metal powder particles; a coil portion embedded in the body and including first and second coil patterns stacked in the one direction; first and second external electrodes disposed on at least the one surface of the body to be spaced apart from each other and connected to the first and second coil patterns, respectively; a shielding layer including a cap portion disposed on the other surface of the body and a sidewall portion disposed on the wall of the body; an external insulating layer disposed between the body and the shielding layer and between the first and second external electrodes and the shielding layer; and a cover layer disposed on the shielding layer to cover the shielding layer and connected to the external insulating layer.

According to an aspect of the present disclosure, a coil component may include: a body; a coil portion embedded in the body; an external electrode disposed on at least a lower surface of the body and connected to the coil portion; a shielding layer covering at least a portion of the body; and an insulating layer disposed between the body and the shielding layer. A distance between the shielding layer and the external electrode may be 10 nm or greater and 100 μm or less.

The external electrode may include a connection portion disposed between the body and the insulating layer and an extending portion extending from the connection portion disposed on a side surface of the body to the lower surface of the body.

The shielding layer may include a sidewall portion covering on a side surface of the body and a cap portion extending from the wall portion onto an upper surface of the body opposing the lower surface.

The sidewall portion of the shielding layer may have a thickness less than that of the cap portion of the shielding layer.

A central portion of the cap portion of the shielding layer may be thicker than an outer portion of the cap portion of the shielding layer.

A thickness of the sidewall portion of the shielding layer may increase in a direction from the lower surface to the upper surface of the body.

The coil component may further include a cover layer covering the shielding layer.

The shielding layer may be sealed by the cover layer and the insulating layer.

According to an aspect of the present disclosure, a coil component may include: a body having first and second surface opposing each other in a first direction of the body, third and fourth surfaces opposing each other in a second direction of the body and connecting the first and second surfaces to each other, and fifth and sixth surfaces opposing each other in a third direction of the body and connecting the first and second surfaces to each other and the third and fourth surfaces to each other; a coil portion including a coil pattern having at least one turn around the third direction, and embedded in the body; an external electrode disposed on the sixth surface of the body and connected to the coil portion; a shielding layer covering the first to fifth surfaces of the body; and an insulating layer disposed between the body and the shielding layer.

The coil component may further include a cover layer covering the shielding layer.

BRIEF DESCRIPTION OF DRAWINGS

The above and other aspects, features, and advantages of the present disclosure will be more clearly understood from the following detailed description taken in conjunction with the accompanying drawings, in which:

FIGS. 2A and 2B are schematic cross-sectional views illustrating the coil component according to a first exemplary embodiment in the present disclosure, wherein FIG. 2A is a cross-sectional view taken along line I-I' of FIG. 1, and FIG. 2B is a cross-sectional view taken along line II-II' of FIG. 1;

DETAILED DESCRIPTION

Figure 1:
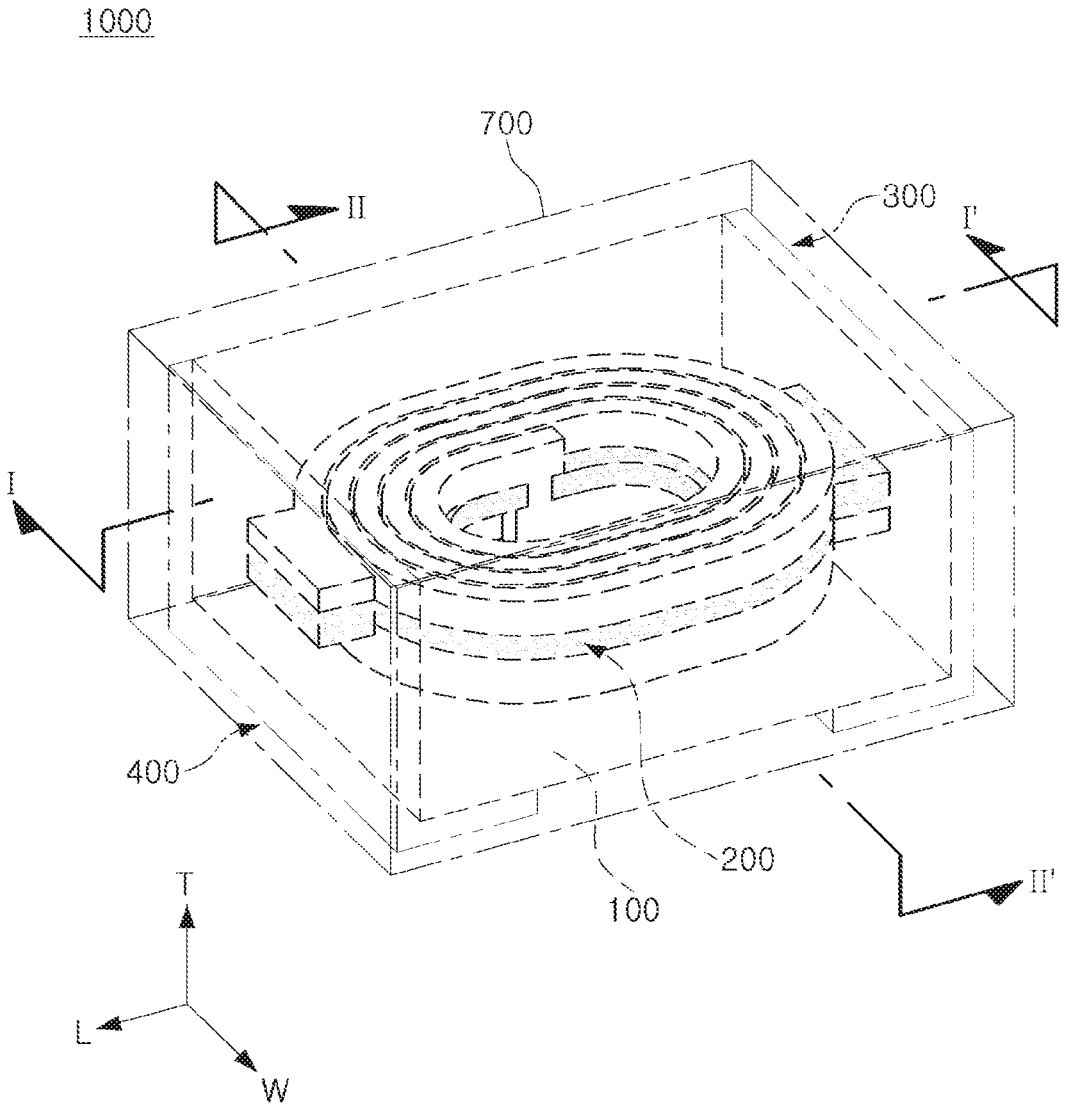
FIG. 1 is a schematic perspective view illustrating a coil component according to a first exemplary embodiment in the present disclosure.

Hereinafter, exemplary embodiments of the present disclosure will now be described in detail with reference to the accompanying drawings.

In the drawings, an L direction refers to a first direction or a length direction, a W direction refers to a second direction or a width direction, and a T direction refers to a third direction or a thickness direction.

Hereinafter, coil components according to exemplary embodiment in the present disclosure will be described in detail with reference to the accompanying drawings. In describing exemplary embodiments in the present disclosure with reference to the accompanying drawings, components that are the same as or correspond to each other will be denoted by the same reference numerals, and an overlapping description therefor will be omitted.

Various kinds of electronic components may be used in an electronic device, and various kinds of coil components may be appropriately used between these electronic components depending on their purposes in order to remove noise, or the like.

That is, the coil components used in the electronic device may be a power inductor, high frequency (HF) inductors, a general bead, a bead for a high frequency (GHz), a common mode filter, and the like.

Hereinafter, a coil component according to an exemplary embodiment in the present disclosure will be described, and for convenience, a case in which the coil component is a power inductor will be described by way of example. However, such a description does not mean that coil components other than an inductor are excluded from the scope of the present disclosure.

First Exemplary Embodiment

Figure 2A:
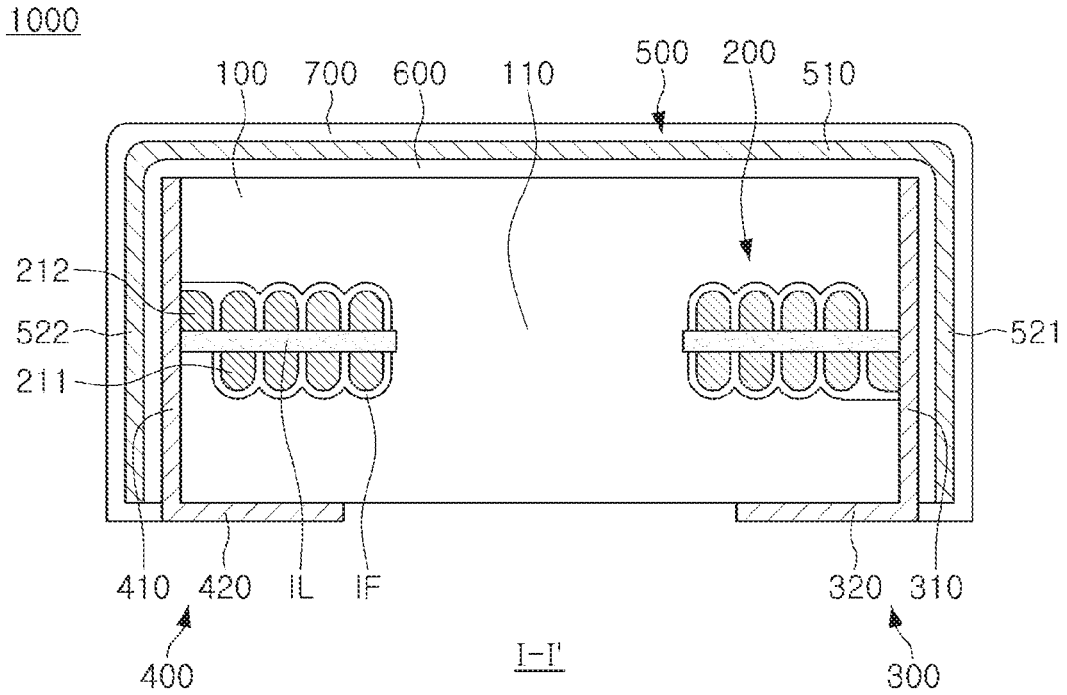
Figure 2B:
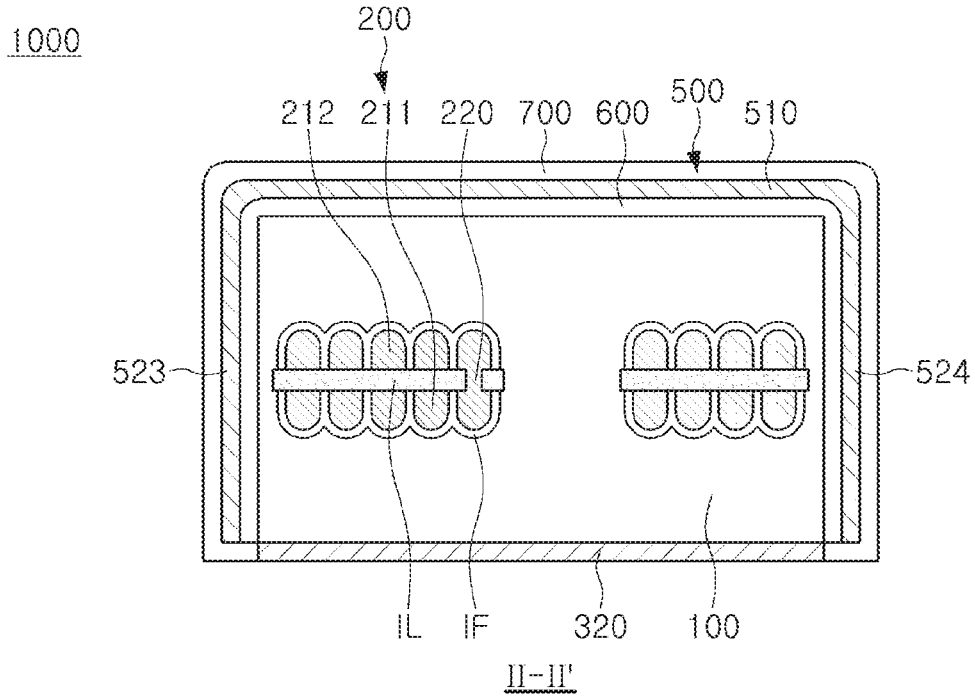

FIG. 1 is a schematic perspective view illustrating a coil component according to a first exemplary embodiment in the present disclosure. FIG. 2A is a cross-sectional view taken along line I-I' of FIG. 1. FIG. 2B is a cross-sectional view taken along line II-II' of FIG. 1.

Referring to FIGS. 1 through 2B, a coil component 1000 according to a first exemplary embodiment in the present disclosure may include a body 100, a coil portion 200, external electrodes 300 and 400, a shielding layer 500, and an insulating layer 600, and may further include a cover layer 700, an internal insulating layer IL, and an insulating film IF.

The body 100 may form an appearance of the coil component 1000 according to the present exemplary embodiment, and may bury the coil portion 200 therein.

The body 100 may generally have a hexahedral shape.

A first exemplary embodiment in the present disclosure will hereinafter be described on the assumption that the body 100 has the hexahedral shape. However, such a description does not exclude a coil component including a body having a shape other than the hexahedral shape from the scope of the present exemplary embodiment.

The body 100 may have a first surface and a second surface opposing each other in the length direction (L), a third surface and a fourth surface opposing each other in the width direction (W), and a fifth surface and a sixth surface opposing each other in the thickness direction (T).

The body 100 may be formed so that the coil component 1000 according to the present exemplary embodiment in which external electrodes 300 and 400, an insulating layer 600, a shielding layer 500, and a cover layer 700 to be described below are formed may have a length of 2.0 mm, a width of 1.2 mm, and a thickness of 0.65 mm by way of example, but is not limited thereto.

The body 100 may include magnetic materials and a resin. In detail, the body may be formed by stacking one or more magnetic composite sheets in which the magnetic materials are dispersed in the resin.

The magnetic material may be ferrite or magnetic metal powder particles.

The ferrite may be, for example, one or more of spinel type ferrites such as Mg—Zn-based ferrite, Mn—Zn-based ferrite, Mn—Mg-based ferrite, Cu—Zn-based ferrite, Mg—Mn—Sr-based ferrite, or Ni—Zn-based ferrite, hexagonal ferrites such as Ba—Zn-based ferrite, Ba—Mg-based ferrite, Ba—Ni-based ferrite, Ba—Co-based ferrite, or Ba—Ni—Co-based ferrite, garnet type ferrite such as Y-based ferrite, Li-based ferrite.

The magnetic metal powder particles may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particles may be one or more of pure iron powder particles, Fe—Si-based alloy powder particles, Fe—Si—Al-based alloy powder particles, Fe—Ni-based alloy powder particles, Fe—Ni—Mo-based alloy powder particles, Fe—Ni—Mo—Cu-based alloy powder particles, Fe—Co-based alloy powder particles, Fe—Ni—Co-based alloy powder particles, Fe—Cr-based alloy powder particles, Fe—Cr—Si-based alloy powder particles, Fe—Si—Cu—Nb-based alloy powder particles, Fe—Ni—Cr-based alloy powder particles, and Fe—Cr—Al-based alloy powder particles.

The magnetic metal powder particles may be amorphous or crystalline. For example, the magnetic metal powder particles may be Fe—Si—B—Cr based amorphous alloy powder particles, but are not necessarily limited thereto.

The ferrite and the magnetic metal powder particles may have average diameters of about 0.1 μm to 30 μm, respectively, but are not limited thereto.

The body 100 may include two kinds or more of magnetic materials dispersed in the resin. Here, different kinds of magnetic materials mean that the magnetic materials dispersed in the resin are distinguished from each other by any one of an average diameter, a composition, crystallinity, and a shape.

The resin may include epoxy, polyimide, liquid crystal polymer (LCP), or the like, or mixtures thereof, but is not limited thereto.

The body 100 may include a core 110 penetrating through a coil portion 200 to be described below. The core 110 may be formed by filling a through-hole of the coil portion 200 with the magnetic composite sheet, but is not limited thereto.

The coil portion 200 may be embedded in the body 100, and may implement characteristics of the coil component. For example, the coil component 1000 according to the present exemplary embodiment may be the power inductor as described above. In this case, the coil portion 200 may serve to store an electric field as a magnetic field to maintain an output voltage, resulting in stabilization of power of an electronic device.

The coil portion 200 may include a first coil pattern 211, a second coil pattern 212, and a via 220.

The first coil pattern 211, the second coil pattern 212, and an internal insulating layer IL to be described below may be stacked in the thickness direction (T) of the body 100.

Each of the first coil pattern 211 and the second coil pattern 212 may have a planar spiral shape. As an example, the first coil pattern 211 may form at least one turn around the thickness (T) direction of the body 100 on one surface of the internal insulating layer IL.

The via 220 may penetrate through the internal insulating layer IL to electrically connect the first coil pattern 211 and the second coil pattern 212 to each other, and may be in contact with each of the first coil pattern 211 and the second coil pattern 212. Resultantly, the coil portion 200 according to the present exemplary embodiment may be formed of one coil generating a magnetic field in the thickness direction (T) of the body 100.

At least one of the first coil pattern 211, the second coil pattern 212, and the via 220 may include one or more conductive layers.

As an example, when the second coil pattern 212 and the via 220 are formed by plating, each of the second coil pattern 212 and the via 220 may include a seed layer of an electroless plating layer and an electroplating layer. Here, the electroplating layer may have a single-layer structure or have a multilayer structure. The electroplating layer having the multilayer structure may be formed in a conformal film structure in which another electroplating layer covers any one electroplating layer, or may be formed in a shape in which another electroplating layer is stacked on only one surface of any one electroplating layer. The seed layer of the second coil pattern 212 and the seed layer of the via 220 may be formed integrally with each other, such that a boundary therebetween may not be formed, but are not limited thereto. The electroplating layer of the second coil pattern 212 and the electroplating layer of the via 220 may be formed integrally with each other, such that a boundary therebetween may not be formed, but are not limited thereto.

As another example, when the coil portion 200 is formed by separately forming the first coil pattern 211 and the second coil pattern 212 and then collectively stacking the first coil pattern 211 and the second coil pattern 212 beneath and on the internal insulating layer IL, respectively, the via 220 may include a high melting point metal layer and a low melting point metal layer having a melting point lower than that of the high melting point metal layer. Here, the low melting point metal layer may be formed of a solder including lead (Pb) and/or tin (Sn). At least a portion of the low melting point metal layer may be melted due to a pressure and a temperature at the time of the collective stacking, such that an inter-metallic compound (IMC) layer may be formed on a boundary between the low melting point metal layer and the second coil pattern 212.

The first coil pattern 211 and the second coil pattern 212 may protrude on a lower surface and an upper surface of the internal insulating layer IL, respectively, as an example. As another example, the first coil pattern 211 may be embedded in a lower surface of the internal insulating layer IL, such that a lower surface of the first coil pattern 211 may be exposed to the lower surface of the internal insulating layer IL, and the second coil pattern 212 may protrude on an upper surface of the internal insulating layer IL. In this case, concave portions may be formed in the lower surface of the first coil pattern 211, such that the lower surface of the internal insulating layer IL and the lower surface of the first coil pattern 211 may not be disposed to be coplanar with each other. As another example, the first coil pattern 211 may be embedded in a lower surface of the internal insulating layer IL, such that a lower surface of the first coil pattern 211 may be exposed to the lower surface of the internal insulating layer IL, and the second coil pattern 212 may be embedded in an upper surface of the internal insulating layer IL, such that an upper surface of the second coil pattern 212 may be exposed to the upper surface of the internal insulating layer IL.

End portions of the first coil pattern 211 and the second coil pattern 212 may be exposed to the first surface and the second surface of the body 100, respectively. The end portion of the first coil pattern 211 exposed to the first surface of the body 100 may be in contact with a first external electrode 300 to be described below, such that the first coil pattern 211 may be electrically connected to the first external electrode 300. The end portion of the second coil pattern 212 exposed to the second surface of the body 100 may be in contact with a second external electrode 400 to be described below, such that the second coil pattern 212 may be electrically connected to the second external electrode 400.

Each of the first coil pattern 211, the second coil pattern 212, and the via 220 may be formed of a conductive material such as copper (Cu), aluminum (Al), silver (Ag), tin (Sn), gold (Au), nickel (Ni), lead (Pb), titanium (Ti), or alloys thereof, but is not limited thereto.

The internal insulating layer IL may be formed of an insulating material including a thermosetting resin such as an epoxy resin, a thermoplastic resin such as a polyimide resin, or a photosensitive insulating resin or be formed of an insulating material having a reinforcement material such as a glass fiber or an inorganic filler impregnated in such an insulating resin. As an example, the internal insulating layer IL may be formed of an insulating material such as prepreg, an Ajinomoto Build-up Film (ABF), FR-4, a Bismaleimide Triazine (BT) resin, a photoimagable dielectric (PID), or the like, but is not limited thereto.

As the inorganic filler, one or more materials selected from the group consisting of silica ($SiO_2$), alumina ($Al_2O_3$), silicon carbide (SiC), barium sulfate ($BaSO_4$), talc, clay, mica powder particles, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of the insulating material including the reinforcing material, the internal insulating layer IL may provide more excellent rigidity. When the internal insulating layer IL is formed of an insulating material that does not include a glass fiber, the internal insulating layer IL may be advantageous for decreasing an entire thickness of the coil portion 200. When the internal insulating layer IL is formed of the insulating material including the photosensitive insulating resin, the number of processes may be decreased, which is advantageous for decreasing a production cost, and a fine hole may be drilled.

The insulating film IF may be formed along surfaces of the first coil pattern 211, the internal insulating layer IL, and the second coil pattern 212. The insulating film IF may be provided in order to protect and insulate the first and second coil patterns 211 and 212, and may include any known insulating material such as parylene, or the like. The insulating material included in the insulating film IF is not particularly limited, but may be any insulating material. The insulating film IF may be formed by a method such as vapor deposition, or the like, but is not limited thereto. That is, the insulating film IF may be formed by stacking insulating films on opposite surfaces of the internal insulating layer IL on which the first and second coil patterns 211 and 212 are formed.

Meanwhile, although not illustrated, the number of at least one of first and second coil patterns 211 and 212 may be plural. As an example, the coil portion 200 may include a plurality of first coil patterns 211, and may have a structure in which another first coil pattern is stacked on a lower surface of any one first coil pattern. In this case, an additional insulating layer may be disposed between the plurality of first coil patterns 211.

The external electrodes 300 and 400 may be disposed on one surface of the body 100, and may be connected to the coil patterns 211 and 212, respectively. The external electrodes 300 and 400 may include the first external electrode 300 connected to the first coil pattern 211 and the second external electrode 400 connected to the second coil pattern 212. In detail, the first external electrode 300 may include a first connection portion 310 disposed on the first surface of the body 100 and connected to the end portion of the first coil pattern 211 and a first extending portion 320 extending from the first connection portion 310 to the sixth surface of the body 100. The second external electrode 400 may include a second connection portion 410 disposed on the second surface of the body 100 and connected to the end portion of the second coil pattern 212 and a second extending portion 420 extending from the second connection portion 410 to the sixth surface of the body 100. The first extending portion 310 and the second extending portion 410 each disposed on the sixth surface of the body 100 may be spaced apart from each other so that the first external electrode 300 and the second external electrode 400 are not in contact with each other.

The external electrodes 300 and 400 may electrically connect the coil component 1000 to the printed circuit board, or the like, when the coil component 1000 according to the present exemplary embodiment is mounted on the printed circuit board, or the like. As an example, the coil component 1000 according to the present exemplary embodiment may be mounted on the printed circuit board so that the sixth surface of the body 100 faces an upper surface of the printed circuit board, and the extending portions 320 and 420 of the external electrodes 300 and 400 disposed on the sixth surface of the body 100 and connection portions of the printed circuit board may be electrically connected to each other.

Each of the external electrodes 300 and 400 may include at least one of a conductive resin layer and an electroplating layer. The conductive resin layer may be formed by printing a paste, and may include one or more conductive metals selected from the group consisting of copper (Cu), nickel (Ni), and silver (Ag), and a thermosetting resin. The electroplating layer may include one or more selected from the group consisting of nickel (Ni), copper (Cu), and tin (Sn).

The shielding layer 500 may be disposed on at least one of the first to fifth surfaces of the body 100, and may reduce radiated noise leaked outwardly from the coil component 1000 according to the present disclosure.

The shielding layer 500 may have a thickness of 10 nm to 100 μm. When the thickness of the shielding layer 500 is less than 10 nm, an electromagnetic interference (EMI) shielding effect may not substantially exist, and when the thickness of the shielding layer 500 exceeds 100 μm, an entire length, width, and thickness of the coil component may be increased, which is disadvantageous for miniaturization of the coil component.

In the present exemplary embodiment, the shielding layer 500 may include a cap portion 510 disposed on the other surface of the body opposing one surface of the body 100 and sidewall portions 521, 522, 523, and 524 connected to the cap portion 510 and disposed on walls of the body connecting one surface of the body 100 and the other surface of the body 100 to each other. That is, the shielding layer 500 may include the cap portion 510 disposed on the fifth surface of the body 100 and the first to fourth sidewall portions 521, 522, 523, and 524 disposed, respectively, on the first to fourth surfaces, which are the walls of the body. The shielding layer 500 according to the present exemplary embodiment may be disposed on all the surfaces of the body 100 except for the sixth surface of the body 100, which is a mounting surface of the coil component 1000 according to the present exemplary embodiment.

The first to fourth sidewall portions 521, 522, 523, and 524 may be formed integrally with one another. That is, the first to fourth sidewall portions 521, 522, 523, and 524 may be formed by the same process, such that boundaries therebetween may not be formed. As an example, the first to fourth sidewall portions 521, 522, 523, and 524 may be formed integrally with one another by stacking a single shielding sheet having an insulating film and a shielding film on the first to fourth surfaces of the body 100. Here, the insulating film of the shielding sheet may correspond to an insulating layer 600 to be described below. Meanwhile, in the above example, a cross section of a region in which any one sidewall portion and another sidewall portion are connected to each other may be formed as a curved surface due to physical processing of the shielding sheet. As another example, when the first to fourth sidewall portions 521, 522, 523, and 524 are formed by performing vapor deposition such as sputtering, or the like, on the first to fourth surfaces of the body 100, the first to fourth sidewall portions 521, 522, 523, and 524 may be formed integrally with one another.

The cap portion 510 and the sidewall portions 521, 522, 523, and 524 may be formed integrally with each other. That is, the cap portion 510 and the sidewall portions 521, 522, 523, and 524 may be formed by the same process, such that boundaries therebetween may not be formed. As an example, the cap portion 510 and the sidewall portions 521, 522, 523, and 524 may be formed integrally with each other by attaching a single shielding sheet including an insulating film and a shielding film to the first to fifth surfaces of the body 100. Here, the insulating film of the shielding sheet may correspond to an insulating layer 600 to be described below. As an example, the cap portion 510 and the sidewall portions 521, 522, 523, and 524 may be formed integrally with each other by forming the shielding layer 500 vapor deposition such as sputtering on the first to fifth surfaces of the body 100 on which the insulating layer 600 is formed.

Each of connection portions between the cap portion 510 and the sidewall portions 521, 522, 523, and 524 may have a curved surface shape. As an example, when the shielding sheet is processed to correspond to a shape of the body and is attached to the first to fifth surfaces of the body 100, a cross section of a region in which the cap portion 510 and the sidewall portions 521, 522, 523, and 524 are connected to each other may be formed as a curved surface. As another example, when the shielding layer 500 is formed on the first to fifth surfaces of the body 100 on which the insulating layer 600 is formed, by the vapor deposition such as the sputtering, a cross section of a region in which the cap portion 510 and the sidewall portions 521, 522, 523, and 524 are connected to each other may be formed as a curved surface.

Each of the first to fourth sidewall portions 521, 522, 523, and 524 may include one end connected to the cap portion 510 and the other end opposing the one end, and a distance from the sixth surface of the body to the other end of any one of the first to fourth sidewall portions 521, 522, 523, and 524 may be different from that from the sixth surface of the body 100 to the other end of another of the first to fourth sidewall portions 521, 522, 523, and 524. As an example, when the shielding layer 500 is formed by attaching the shielding film described above, distances from the other ends of the sidewall portions 521, 522, 523, and 524 to the sixth surface of the body 100 may be different from one another due to a tolerance or a need on a design.

The shielding layer 500 may include at least one of a conductor and a magnetic material. As an example, the conductor may be a metal or an alloy including one or more selected from the group consisting of copper (Cu), aluminum (Al), iron (Fe), silicon (Si), boron (B), chromium (Cr), niobium (Nb), and nickel (Ni), and may be Fe—Si or Fe—Ni. In addition, the shielding layer 500 may include one or more selected from the group consisting of ferrite, permalloy, and an amorphous ribbon. The shielding layer 500 may have a double-layer structure including a layer including a conductor and a layer including a magnetic material or have a single-layer structure including a conductor and/or a magnetic material.

The shielding layer 500 may include two or more fine structures separated from each other. As an example, when each of the cap portion 510 and the sidewall portions 521, 522, 523, and 524 is formed of an amorphous ribbon sheet separated into a plurality of pieces, each of the cap portion 510 and the sidewall portions 521, 522, 523, and 524 may include a plurality of fine structures separated from each other.

The insulating layer 600 may be disposed between the body 100 and the shielding layer 500 to electrically isolate the shielding layer 500 from the body 100 and the external electrodes 300 and 400. In the present exemplary embodiment, the insulating layer 600 may be disposed on the first to fifth surfaces of the body 100. Meanwhile, in the present exemplary embodiment, the connection portions 310 and 410 of the external electrodes 300 and 400 are formed on the first and second surfaces of the body 100, respectively. The connection portions 310 and 410 of the external electrodes 300 and 400, the insulating layer 600, and the sidewall portions 521 and 522 of the shielding layer 500 may thus be sequentially disposed on each of the first and second surfaces of the body 100.

The insulating layer 600 may include a thermoplastic resin such as polystyrenes, vinyl acetates, polyesters, polyethylenes, polypropylenes, polyamides, rubbers, or acryls, a thermosetting resin such as phenols, epoxies, urethanes, melamines, or alkyds.

The insulating layer 600 may have an adhesive function. As an example, when the insulating layer 600 and the shielding layer 500 are formed of a shielding sheet including an insulating film and a shielding film, the insulating film of the shielding sheet may include an adhesive component to adhere the shielding film to surfaces of the body 100. In this case, an adhesive layer may separately be formed between one surface of the insulating layer 600 and the body 100. However, when the insulating layer 600 is formed using an insulating film in a B-stage, a separate adhesive layer may not be formed on one surface of the insulating layer 600.

The insulating layer 600 may be formed in a thickness range of 10 nm to 100 μm. Accordingly, a distance between the external electrodes 300 and 400, and the shielding layer 500 may be from 10 nm to 100 μm. When a thickness of the insulating layer 600 is less than 10 nm, characteristics of the coil component such as a Q factor, or the like, may be deteriorated, and when a thickness of the insulating layer 600 exceeds 100 μm, an entire length, width, and thickness of the coil component may be increased, which is disadvantageous for miniaturization of the coil component.

The cover layer 700 may be disposed on the shielding layer 500 to cover the shielding layer 500, and may be in contact with the insulating layer 600. That is, the cover layer 700 may bury the shielding layer 500 therein together with the insulating layer 600. In the present exemplary embodiment, the cover layer 700 may be disposed on the first to fifth surfaces of the body 100, and may cover the other end of each of the first to fourth sidewall portions 521, 522, 523, and 524 to be in contact with the insulating layer 600. The cover layer 700 may cover the other end of each of the first to fourth sidewall portions 521, 522, 523, and 524 to prevent electrical connection between the first to fourth sidewall portions 521, 522, 523, and 524 and the extending portions 320 and 420 of the external electrodes 300 and 400. In addition, the cover layer 700 may prevent the shielding layer 500 from being electrically connected to another external electronic component.

The cover layer 700 may include at least one of a thermoplastic resin such as polystyrenes, vinyl acetates, polyesters, polyethylenes, polypropylenes, polyamides, rubbers, or acryls, a thermosetting resin such as phenols, epoxies, urethanes, melamines, or alkyds, and a photosensitive insulating resin.

As an example, the cover layer 700 may be formed simultaneously with the insulating layer 600 and the shielding layer 500 by disposing an insulating film of a shielding sheet including the insulating film, a shielding film, and a cover film to face the body 100 and then stacking the shielding sheet on the body 100. As another example, the cover layer 700 may be by stacking a shielding sheet including an insulating film and a shielding film on the body and then stacking a cover film on the body 100 to cover the shielding layer 500. As another example, the cover layer 700 may be formed on the first to fifth surfaces of the body 100 by forming an insulating material on the shielding layer 500 by vapor deposition such as chemical vapor deposition (CVD), or the like, and may cover the shielding layer 500.

The cover layer 700 may have an adhesive function. As an example, the cover film may include an adhesive component to be bonded to the shielding film in the shielding sheet including the insulating film, the shielding film, and the cover film.

The cover layer 700 may be formed in a thickness range of 10 nm to 100 μm. When a thickness of the cover layer 700 is less than 10 nm, an insulation property may be weak, such that a short-circuit between an external electronic component and the coil component may occur, and when a thickness of the cover layer 700 exceeds 100 μm, an entire length, width, and thickness of the coil component may be increased, which is disadvantageous for miniaturization of the coil component.

The sum of the thicknesses of the insulating layer 600, the shielding layer 500, and the cover layer 700 may be 30 nm or greater and 100 μm or less. When the sum of the thicknesses of the insulating layer 600, the shielding layer 500, and the cover layer 700 is less than 30 nm, a problem such as an electrical short-circuit, a decrease in characteristics of the coil component such as a Q factor, and the like, may occur, and when the sum of the thicknesses of the insulating layer 600, the shielding layer 500, and the cover layer 700 exceeds 100 μm, the entire length, width, and thickness of the coil component may be increased, which is disadvantageous for miniaturization of the coil component.

Meanwhile, although not illustrated in FIGS. 1 through 2B, a separate additional insulating layer distinguished from the insulating layer 600 may be formed on regions of the first to sixth surfaces of the body 100 on which the external electrodes 300 and 400 are not formed. That is, the separate additional insulating layer distinguished from the insulating layer 600 may be formed on the third to fifth surfaces of the body 100 and on a region of the sixth surface of the body on which the extending portions 320 and 420 are not formed. In this case, the insulating layer 600 according to the present exemplary embodiment may be formed on the surfaces of the body 100 to be in contact with the additional insulating layer. The additional insulating layer may serve as a plating resist in forming the external electrodes 300 and 400 by plating, but is not limited thereto.

Since the insulating layer 600 and the cover layer 700 according to the present disclosure are disposed in the coil component itself, the insulating layer 600 and the cover layer 700 may be distinguished from a molding material molding the coil component and the printed circuit board in a process of mounting the coil component on the printed circuit board. Therefore, the insulating layer 600 may not be in contact with the printed circuit board, and may not be supported and fixed by the printed circuit board unlike the molding material. In addition, unlike the molding material surrounding connection members such as solder balls connecting the coil component and the printed circuit board to each other, the insulating layer 600 and the cover layer 700 according to the present disclosure may not surround the connection members. In addition, since the insulating layer 600 according to the present disclosure is not the molding material formed by heating an epoxy molding compound (EMC), or the like, moving the EMC onto the printed circuit board, and then hardening the EMC, generation of voids at the time of forming the molding material, occurrence of warpage of the printed circuit board due to a difference between a coefficient of thermal expansion (CTE) of the molding material and a CTE of the printed circuit board, and the like, need not to be considered.

In addition, since the shielding layer 500 according to the present disclosure is disposed in the coil component itself, the shielding layer 500 may be distinguished from a shield can coupled to the printed circuit board in order to shield electromagnetic interference (EMI), or the like, after the coil component is mounted on the printed circuit board. As an example, it may not be considered to connect the shielding layer 500 according to the present disclosure to a ground layer of the printed circuit board, unlike the shield can.

In the coil component according to the present exemplary embodiment, a leaked magnetic flux generated in the coil component may be more efficiently blocked by forming the shielding layer 500 in the coil component itself. That is, in accordance with thinness and performance improvement of an electronic device, the total number of electronic components included in the electronic device has increased and a distance between adjacent electronic components has decreased. However, in the present disclosure, the respective coil components themselves may be shielded, such that leaked magnetic fluxes generated in the respective coil components may be more efficiently blocked, which may be more advantageous for thinness and performance improvement of the electronic device. In addition, an amount of effective magnetic material in a shielding region may be increased as compared to a case of using the shield can, and characteristics of the coil component may thus be improved.

Second Exemplary Embodiment

Figure 3:
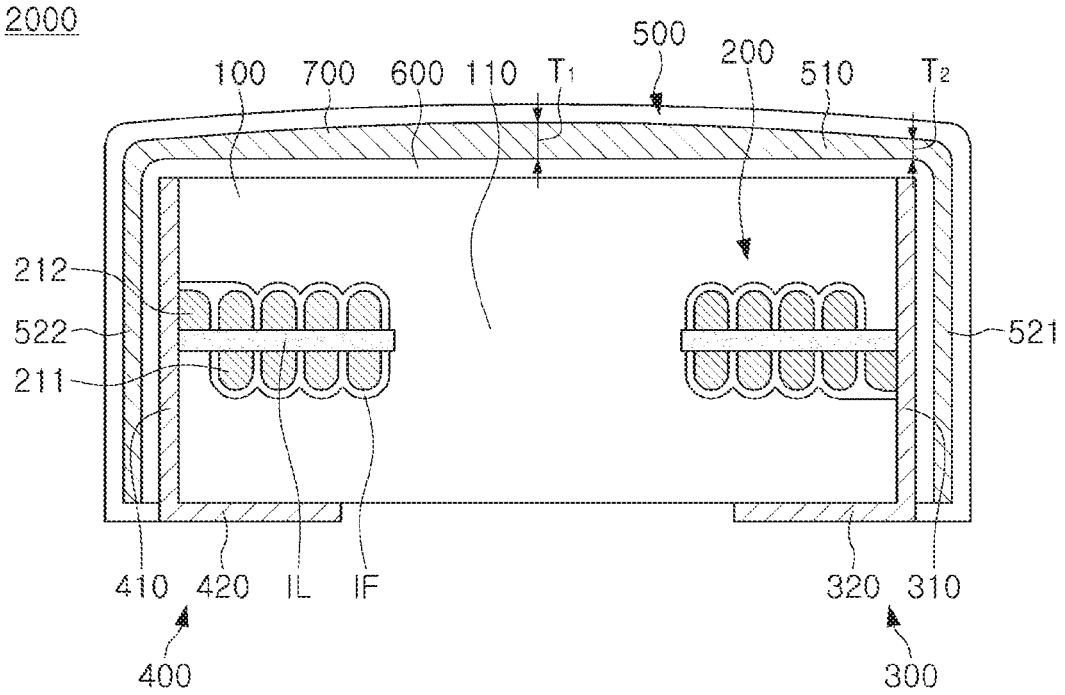
FIG. 3 is a cross-sectional view illustrating a coil component according to a second exemplary embodiment in the present disclosure and corresponding to the cross-sectional view taken along line I-I' of FIG. 1.

FIG. 3 is a cross-sectional view illustrating a coil component according to a second exemplary embodiment in the present disclosure and corresponding to the cross-sectional view taken along line I-I' of FIG. 1.

Referring to FIGS. 1 through 3, a coil component 2000 according to the present exemplary embodiment may be different in a cap portion 510 from the coil component 1000 according to the first exemplary embodiment in the present disclosure. Therefore, in describing the present exemplary embodiment, only the cap portion 510 different from that of the first exemplary embodiment in the present disclosure will be described. The description in the first exemplary embodiment in the present disclosure may be applied to other components of the present exemplary embodiment as it is.

Referring to FIG. 3, a central portion of the cap portion 510 may be formed at a thickness $T_1$ greater than a thickness $T_2$ of an outer side portion thereof. This will be described in detail.

The respective coil patterns 211 and 212 constituting the coil portion 200 according to the present exemplary embodiment may form a plurality of turns from the center of the internal insulating layer IL to an outer side of the internal insulating layer IL on opposite surfaces of the internal insulating layer IL, respectively, and may be stacked in the thickness direction (T) of the body 100 and be connected to each other by the via 220. Resultantly, in the coil component 2000 according to the present exemplary embodiment, a magnetic flux density may be highest at a central portion of a length direction (L)-width direction (W) plane of the body 100 perpendicular to the thickness direction (T) of the body 100. Therefore, in the present exemplary embodiment, in forming the cap portion 510 disposed on the fifth surface of the body 100 substantially parallel with the length direction (L)-width direction (W) plane of the body 100, the central portion of the cap portion 510 may be formed at the thickness $T_1$ greater than the thickness 12 of the outer side portion thereof in consideration of a magnetic flux density distribution on the length direction (L)-width direction (W) plane of the body 100.

In this way, in the coil component 2000 according to the present exemplary embodiment, the cap portion 510 may be formed at different thicknesses depending on the magnetic flux density distribution to more efficiently decrease a leaked magnetic flux.

Third Exemplary Embodiment

Figure 4:
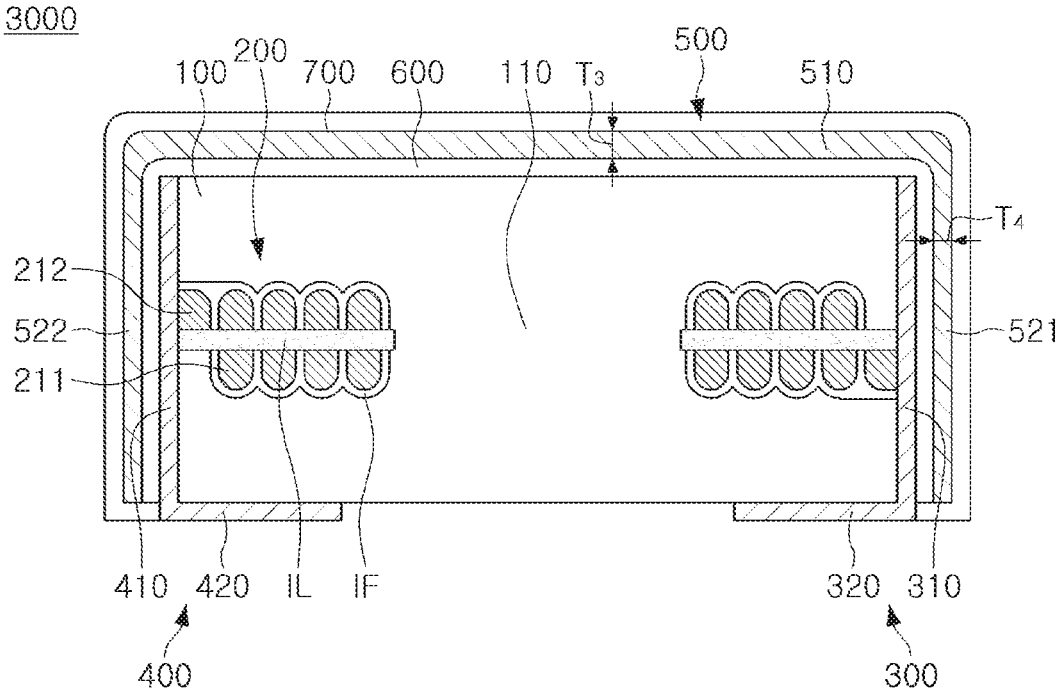
FIG. 4 is a cross-sectional view illustrating a coil component according to a third exemplary embodiment in the present disclosure and corresponding to the cross-sectional view taken along line I-I' of FIG. 1.
Figure 5:
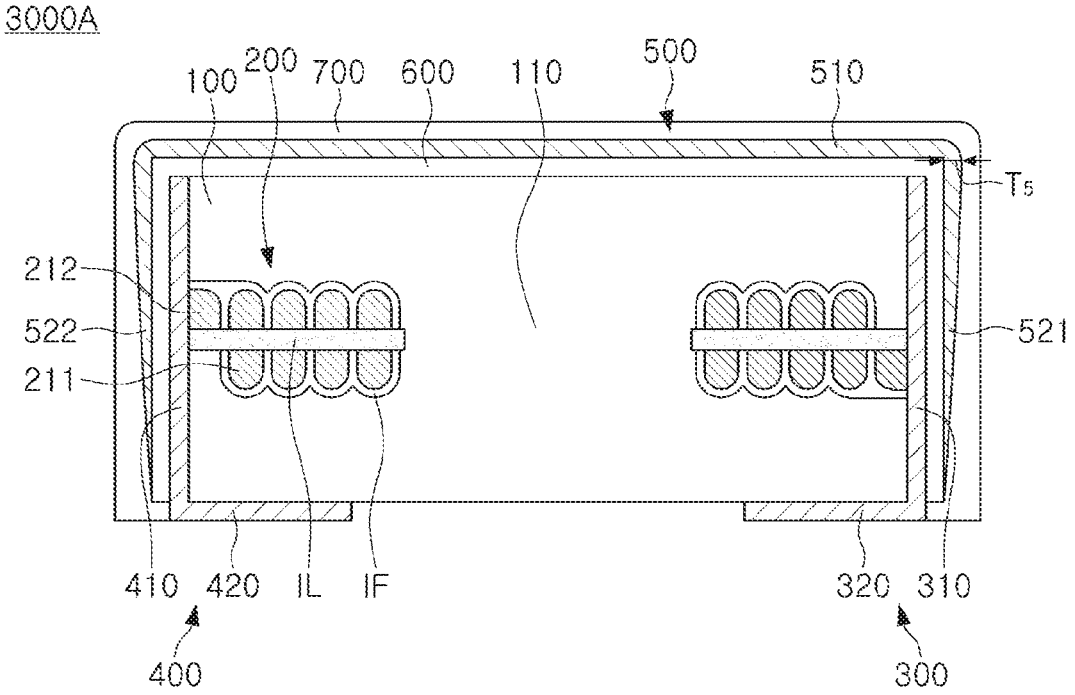
FIG. 5 is a cross-sectional view illustrating a coil component according to a modified example of a third exemplary embodiment in the present disclosure and corresponding to the cross-sectional view taken along line I-I' of FIG. 1.

FIG. 4 is a cross-sectional view illustrating a coil component according to a third exemplary embodiment in the present disclosure and corresponding to the cross-sectional view taken along line I-I' of FIG. 1. FIG. 5 is a cross-sectional view illustrating a coil component according to a modified example of a third exemplary embodiment in the present disclosure and corresponding to the cross-sectional view taken along line I-I' of FIG. 1.

Referring to FIGS. 1 through 5, a coil component 3000 according to the present exemplary embodiment may be different in a cap portion 510 and sidewall portions 521, 522, 523, and 524 from the coil components 1000 and 2000 according to the first and second exemplary embodiments in the present disclosure. Therefore, in describing the present exemplary embodiment, only the cap portion 510 and the sidewall portions 521, 522, 523, and 524 different from those of the first and second exemplary embodiments in the present disclosure will be described. The description in the first or second exemplary embodiment in the present disclosure may be applied to other components of the present exemplary embodiment as it is.

Referring to FIG. 4, a thickness $T_3$ of the cap portion 510 may be greater than a thickness $T_4$ of each of the sidewall portions 521, 522, 523, and 524.

As described above, the coil portion 200 may generate a magnetic field in the thickness direction (T) of the body 100. Resultantly, a magnetic flux leaked in the thickness direction (T) of the body 100 may be greater than those leaked in other directions. Therefore, the cap portion 510 disposed on the fifth surface of the body 100 perpendicular to the thickness direction (T) of the body 100 may be formed at a thickness greater than that of each of the sidewall portions 521, 522, 523, and 524 disposed on walls of the body 100 to more efficiently decrease the leaked magnetic flux.

As an example, the cap portion 510 may be formed at the thickness greater than that of each of the sidewall portions 521, 522, 523, and 524 by forming a shielding layer on the first to fifth surfaces of the body 100 using a shielding sheet including an insulating film and a shielding film and additionally forming a shielding material on only the fifth surface of the body 100. As another example, the cap portion 510 may be formed at the thickness greater than that of each of the sidewall portions 521, 522, 523, and 524 by disposing the body 100 so that the fifth surface of the body 100 faces a target and then performing sputtering for forming the shielding layer 500. However, the scope of the present exemplary embodiment is not limited to the example described above.

Referring to FIGS. 4 and 5, in a case in which the cap portion 510 is formed at the thickness 13 greater than the thickness $T_4$ of each of the sidewall portions 521, 522, 523, and 524, a thickness $T_5$ of one end of each of the sidewall portions 521, 522, 523, and 524 may be greater than that of the other end of the sidewall portion 520.

As an example, when the cap portion 510 and the sidewall portions 521, 522, 523, and 524 are formed by plating, a current density may be concentrated due to edged shapes in edge portions of the body 100 at which the fifth surface of the body 100 and the first to fourth surfaces of the body 100 are connected to each other, that is, regions in which one end of the sidewall portion 520 is formed. Therefore, one end of the sidewall portion 520 may be formed at a thickness relatively greater than that of the other end of the sidewall portion 520. As another example, one end of the sidewall portion 520 may be formed at a thickness relatively greater than that of the other end of the sidewall portion 520 by disposing the body 100 so that the fifth surface of the body 100 faces a target and then performing sputtering for forming the shielding layer 500. However, the scope of the present modified example is not limited to the example described above.

In this way, in the coil component 3000 according to the present exemplary embodiment, the leaked magnetic flux may be efficiently decreased in consideration of a direction of a magnetic field formed by the coil portion 200.

Fourth Exemplary Embodiment

Figure 6:
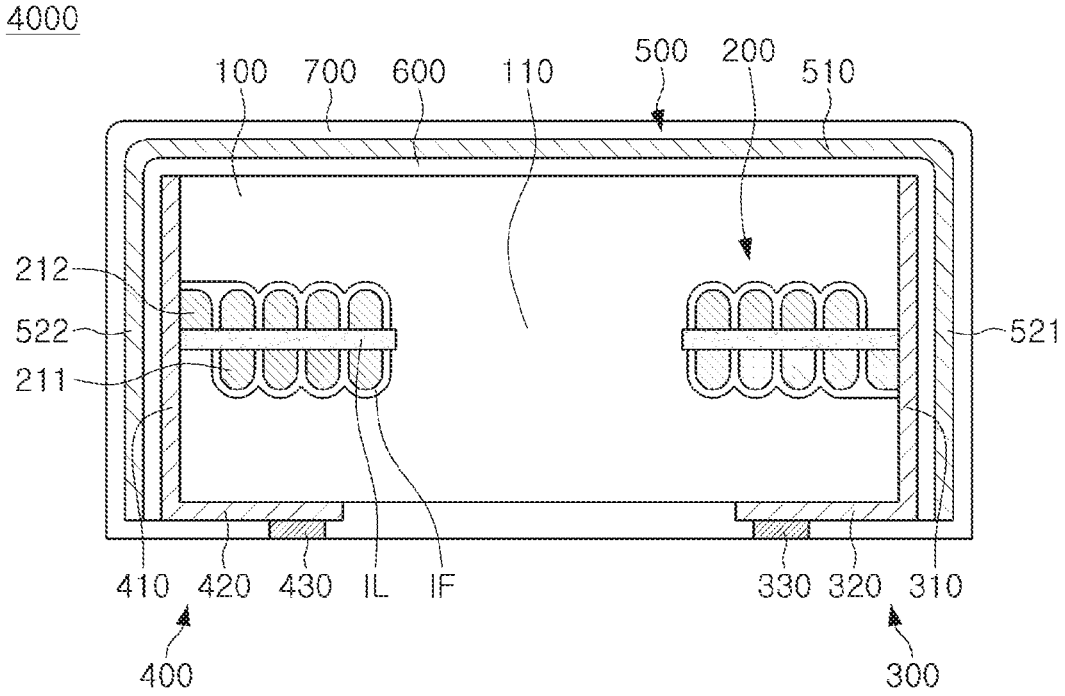
FIG. 6 is a cross-sectional view illustrating a coil component according to a fourth exemplary embodiment in the present disclosure and corresponding to the cross-sectional view taken along line I-I' of FIG. 1.

FIG. 6 is a cross-sectional view illustrating a coil component according to a fourth exemplary embodiment in the present disclosure and corresponding to the cross-sectional view taken along line I-I' of FIG. 1.

Referring to FIGS. 1 through 6, a coil component 4000 according to the present exemplary embodiment may be different in a cover layer 700 and external electrodes 300 and 400 from the coil components 1000, 2000, and 3000 according to the first to third exemplary embodiments in the present disclosure. Therefore, in describing the present exemplary embodiment, only the cover layer 700 and the external electrodes 300 and 400 different from those of the first to third exemplary embodiments in the present disclosure will be described. The description in the first to third exemplary embodiments in the present disclosure may be applied to other components of the present exemplary embodiment as it is.

Referring to FIG. 6, the cover layer 700 according to the present exemplary embodiment may be formed on the first to sixth surfaces of the body 100 to cover the shielding layer 500. That is, the cover layer 700 may cover the extending portions 320 and 420 of the external electrodes 300 and 400. In addition, referring to FIG. 6, the external electrodes 300 and 400 according to the present exemplary embodiment may further include penetration portions 330 and 430 penetrating through the cover layer 700 and connected to the extending portions 320 and 420, respectively.

The cover layer 700 may include a photosensitive insulating resin, but is not limited thereto. When the cover layer 700 includes the photosensitive insulating resin, holes in which the penetration portions 330 and 430 are formed may be formed by a photolithography method.

In the external electrodes 300 and 400 according to the present exemplary embodiment, the connection portions 310 and 410 and the extending portions 320 and 420 may include copper plating layers and be formed integrally with each other, the penetration portions 330 and 430 may include at least one of tin and nickel. As an example, the penetration portions 330 and 430 may include nickel plating layers in contact with the extending portions 320 and 420 and tin plating layers formed on the nickel plating layers, respectively.

In this way, in the coil component 400 according to the present exemplary embodiment, electrical connection of the shielding layer 500 to the external electrodes 300 and 400 and/or an external electronic component may be more efficiently prevented.

Fifth Exemplary Embodiment

Figure 7A:
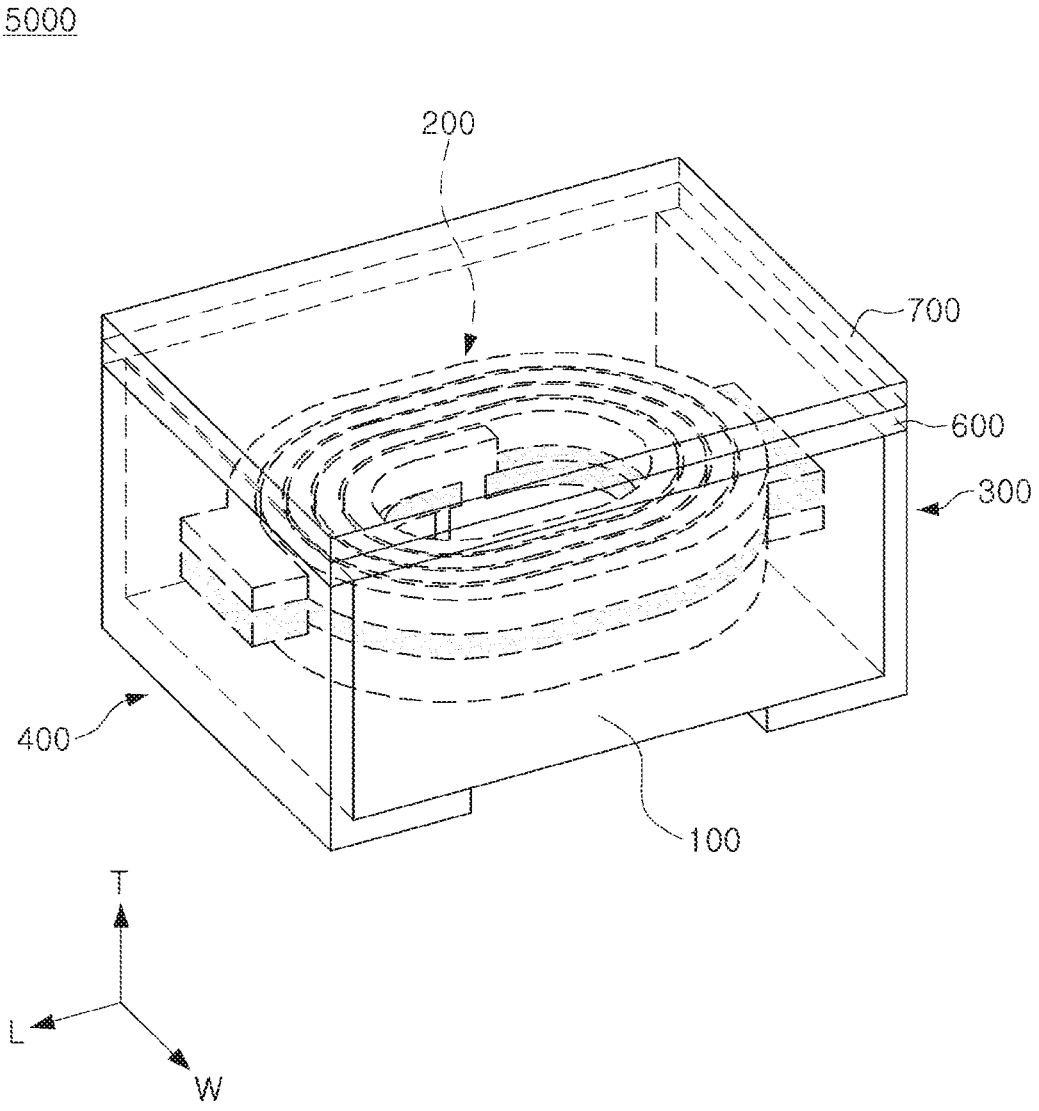
FIG. 7A is a schematic perspective view illustrating a coil component according to a fifth exemplary embodiment in the present disclosure.
Figure 7B:
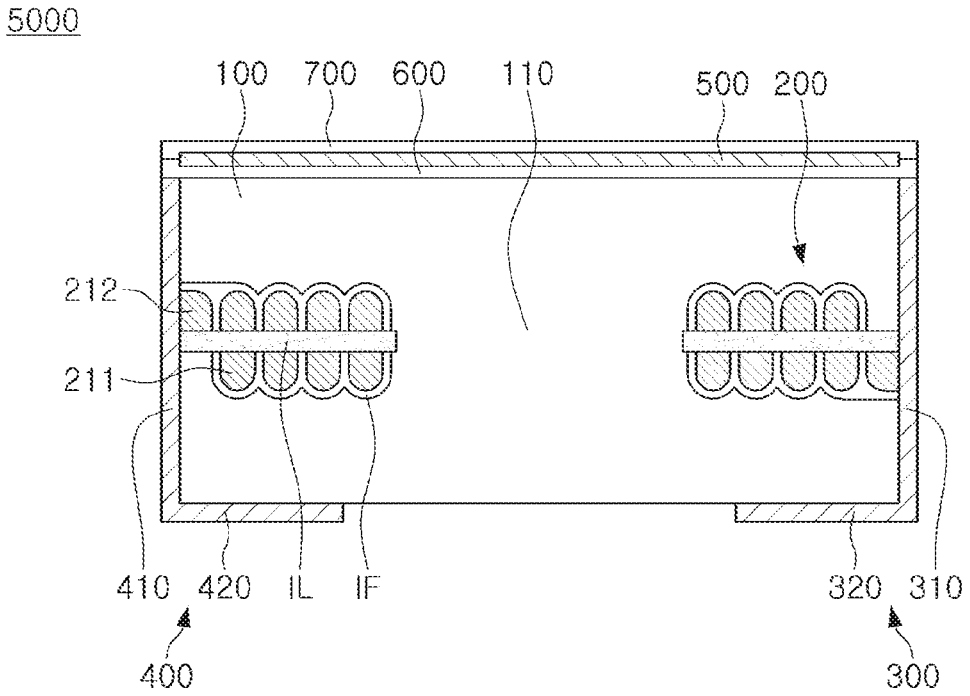
FIG. 7B is a cross-sectional view taken along an LT plane of FIG. 7A.

FIG. 7A is a schematic perspective view illustrating a coil component according to a fifth exemplary embodiment in the present disclosure. FIG. 7B is a cross-sectional view taken along an LT plane of FIG. 7A.

Referring to FIGS. 1 through 7, a coil component 5000 according to the present exemplary embodiment may be different in a structure of a shielding layer 500 from the coil components 1000, 2000, 3000, and 4000 according to the first to fourth exemplary embodiments in the present disclosure. Therefore, in describing the present exemplary embodiment, only the shielding layer 500 different from those of the first to third exemplary embodiments in the present disclosure will be described. The description in the first to fourth exemplary embodiments in the present disclosure may be applied to other components of the present exemplary embodiment as it is.

In detail, in the present exemplary embodiment, the shielding layer 500 may include only a cap portion 510.

As described above in another exemplary embodiment in the present disclosure, in the coil portion 200, the largest leaked magnetic flux may be generated in the thickness direction (T) of the body 100. Therefore, in the present exemplary embodiment, the shielding layer 500 may be formed on only the fifth surface of the body 100 perpendicular to the thickness direction (T) of the body 100 to more simply and efficiently block the leaked magnetic flux.

Sixth Exemplary Embodiment

Figure 8A:
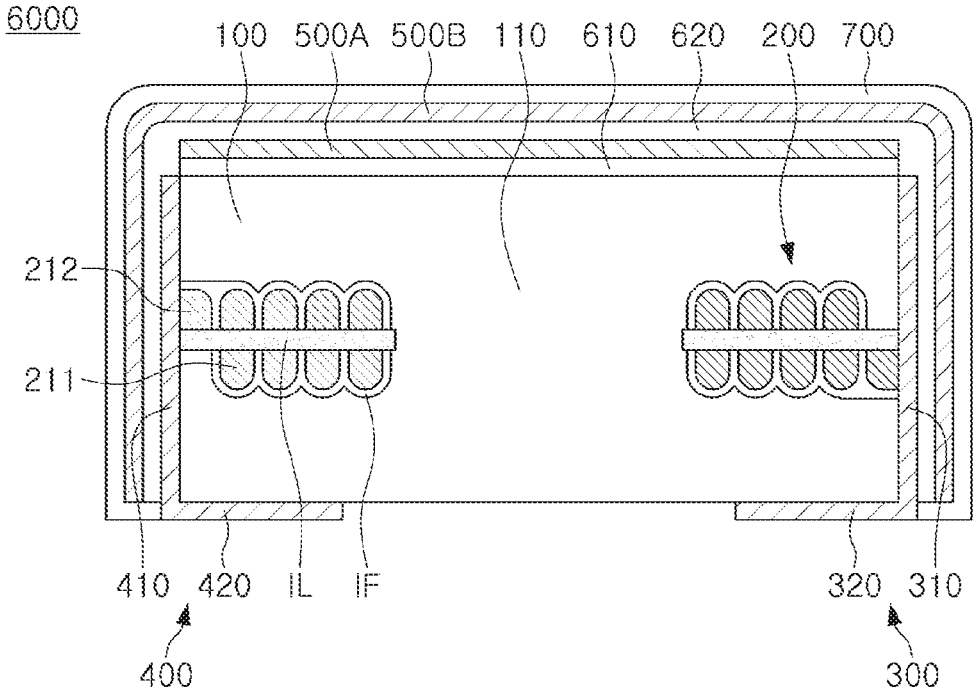
FIG. 8A is a cross-sectional view illustrating a coil component according to a sixth exemplary embodiment in the present disclosure and corresponding to the cross-sectional view taken along line I-I' of FIG. 1.
Figure 8B:
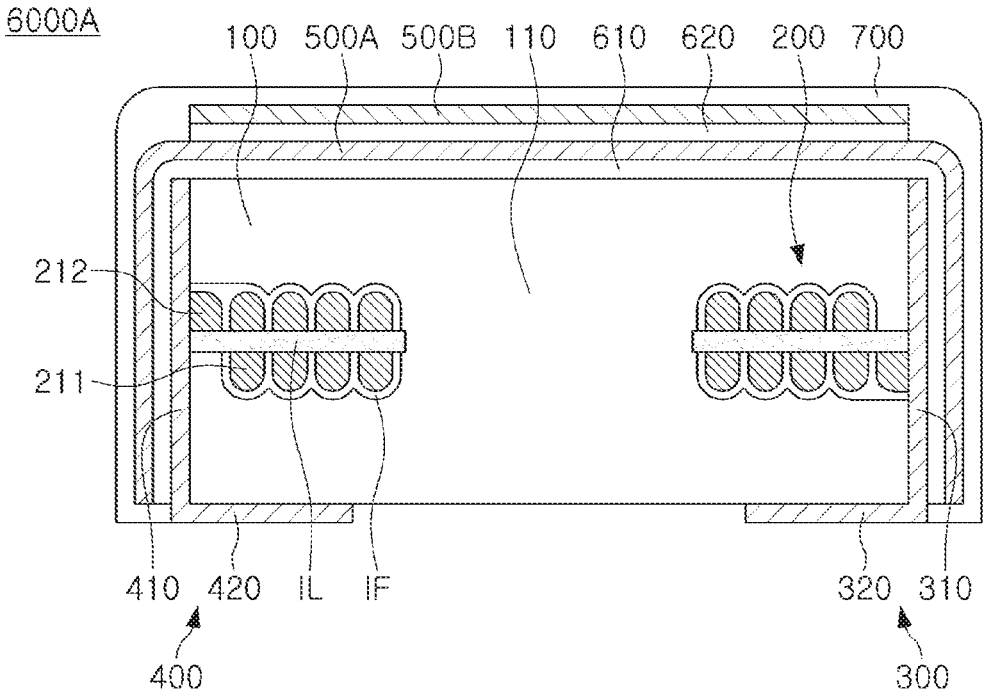
FIG. 8B is a cross-sectional view illustrating a coil component according to a modified example of a sixth exemplary embodiment in the present disclosure and corresponding to the cross-sectional view taken along line I-I' of FIG. 1.

FIG. 8A is a cross-sectional view illustrating a coil component according to a sixth exemplary embodiment in the present disclosure and corresponding to the cross-sectional view taken along line I-I' of FIG. 1. FIG. 8B is a cross-sectional view illustrating a coil component according to a modified example of a sixth exemplary embodiment in the present disclosure and corresponding to the cross-sectional view taken along line I-I' of FIG. 1.

Referring to FIGS. 1 through 8B, coil components 6000 and 6000A according to the present exemplary embodiment and a modified example of the present exemplary embodiment may be different in shielding layers 500A and 500B from the coil components 1000, 2000, 3000, 4000, and 500 according to the first to fifth exemplary embodiments in the present disclosure. Therefore, in describing the present exemplary embodiment, only the shielding layers 500A and 500B different from those of the first to fifth exemplary embodiments in the present disclosure will be described. The description in the first to fifth exemplary embodiments in the present disclosure may be applied to other components of the present exemplary embodiment as it is.

In the present exemplary embodiment, the shielding layers 500A and 500B may be a plurality of layers separated from each other by an insulating layer 620. In detail, the shielding layers 500A and 500B may include a first shielding layer 500A and a second shielding layer 500B separated from each other by a second insulating layer 620.

The first shielding layer 500A may be disposed on the fifth surface of the body, which is the other surface of the body 100. A first insulating layer 610 may be disposed between the other surface of the body 100 and the first shielding layer 500A.

The first shielding layer 500A may include a magnetic material. As an example, the first shielding layer 500A may include one or more selected from the group consisting of ferrite, permalloy, and an amorphous ribbon.

The second shielding layer 500B may be disposed above the first shielding layer 500A, and may be disposed on each of a plurality of walls of the body 100. That is, the second shielding layer 500B may have a structure shielding five surfaces of the body 100 described above.

The second shielding layer 500B may include a conductor. As an example, the second shielding layer 500B may be a metal or an alloy including one or more selected from the group consisting of copper (Cu), aluminum (Al), iron (Fe), silicon (Si), boron (B), chromium (Cr), niobium (Nb), and nickel (Ni), and may be Fe—Si or Fe—Ni.

Since the second insulating layer 620 is disposed between the first shielding layer 500A and the second shielding layer 500B, the second insulating layer 620 may be disposed on each of the first to fifth surfaces of the body 100, similar to the second shielding layer 500B. That is, the second insulating layer 620 may cover five surfaces of the six surfaces of the body 100.

In the present exemplary embodiment, both of an absorption shielding effect by the first shielding layer 500A including the magnetic material and a reflection shielding effect by the second shielding layer 500B including the conductor may be accomplished. That is, in a low frequency band of 1 MHz or less, a leaked magnetic flux may be absorbed and shielded by the first shielding layer, and in a high frequency band exceeding 1 MHz, a leaked magnetic flux may be reflected and shielded by the second shielding layer. Therefore, in the coil component 6000 according to the present exemplary embodiment, the leaked magnetic flux may be shielded in a relatively wide frequency band.

Meanwhile, although a case in which a shielding layer including the magnetic material is the first shielding layer 500A and is disposed inside the shielding layer 500B including the conductor is illustrated in FIG. 8A, it is only an example. That is, as in the modified example of the present exemplary embodiment illustrated in FIG. 8B, a shielding layer including the magnetic material may also be disposed outside the shielding layer 500A including the conductor. In this case, a shielding layer including the magnetic material may be the second shielding layer 500B.

Seventh Exemplary Embodiment

Figure 9:
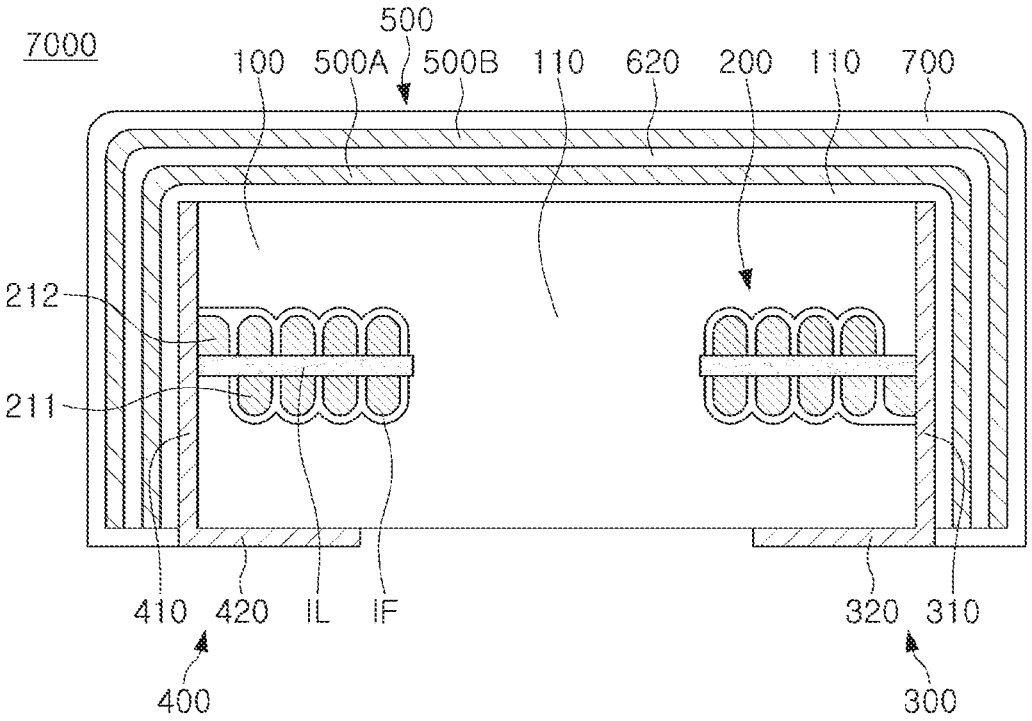
FIG. 9 is a cross-sectional view illustrating a coil component according to a seventh exemplary embodiment in the present disclosure and corresponding to the cross-sectional view taken along line I-I' of FIG. 1.

FIG. 9 is a cross-sectional view illustrating a coil component according to a seventh exemplary embodiment in the present disclosure and corresponding to the cross-sectional view taken along line I-I' of FIG. 1.

Referring to FIGS. 1 through 9, a coil component 7000 according to the present exemplary embodiment may be different in a structure of a shielding layer 500 from the coil components 1000, 2000, 3000, 4000, 5000, and 6000 according to the first to sixth exemplary embodiments in the present disclosure. Therefore, in describing the present exemplary embodiment, only the shielding layer 500 different from those of the first to sixth exemplary embodiments in the present disclosure will be described. The description in the first to sixth exemplary embodiments in the present disclosure may be applied to other components of the present exemplary embodiment as it is.

Referring to FIG. 9, the shielding layer 500 according to the present exemplary embodiment may be formed in a double-layer structure.

In the present exemplary embodiment, the shielding layers 500A and 500B may be formed in the double-layer structure, and a leaked magnetic flux passing through a first shielding layer 500A disposed relatively adjacent to the body 100 may thus be shielded by a second shielding layer 500B disposed to be relatively spaced apart from the body 100. Therefore, in the coil component 7000 according to the present exemplary embodiment, the leaked magnetic flux may be more efficiently blocked.

In addition, in the present exemplary embodiment, both of the shielding layers 500A and 500B may be formed on each of the first to fifth surfaces of the body 100. That is, both of the double shielding layers according to the present exemplary embodiment may be formed over five surfaces of the body.

Each of the first and second shielding layers 500A and 500B may be formed of a conductor, but is not limited thereto.

In addition, in the present exemplary embodiment, the number of insulating layers 610 and 620 may be plural. A first insulating layer 610 may be formed between the body 100 and the first shielding layer 500A, and a second insulating layer 620 may be formed between the first shielding layer 500A and the second shielding layer 500B. Since each of the first and second shielding layers 500A and 500B is formed on the first to fifth surfaces of the body 100, both of the first and second insulating layers 610 and 620 may be disposed on the first to fifth surfaces of the body 100.

The second insulating layer 620 formed between the first shielding layer 500A and the second shielding layer 500B may serve as a wave guide of noise reflected from the second shielding layer 500B.

Modified Examples

Figure 10A:
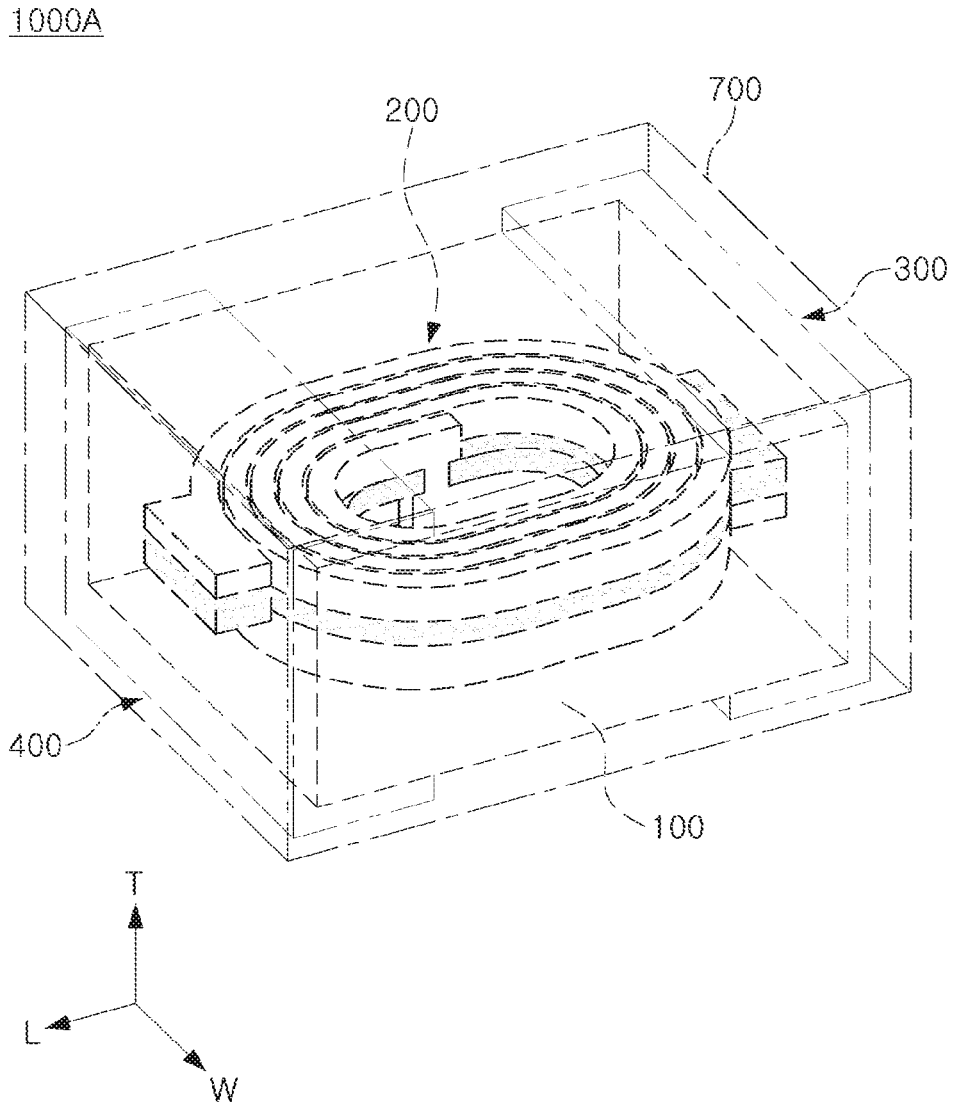
FIGS. 10A through 13 are schematic views illustrating modified examples in the present disclosure.
Figure 10B:
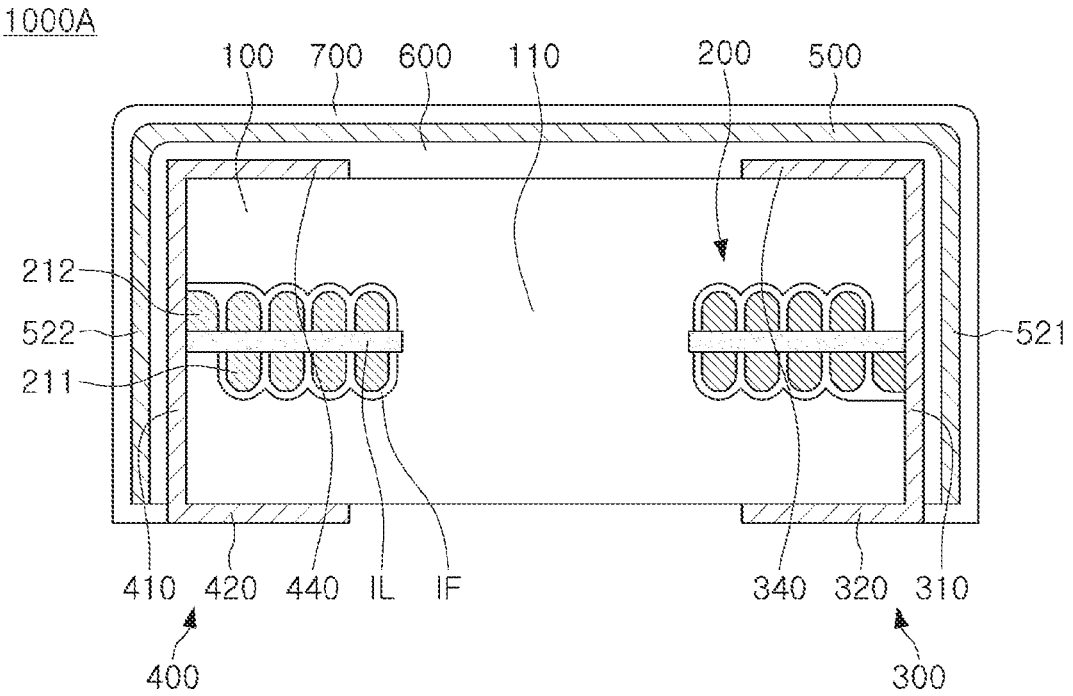
Figure 10C:
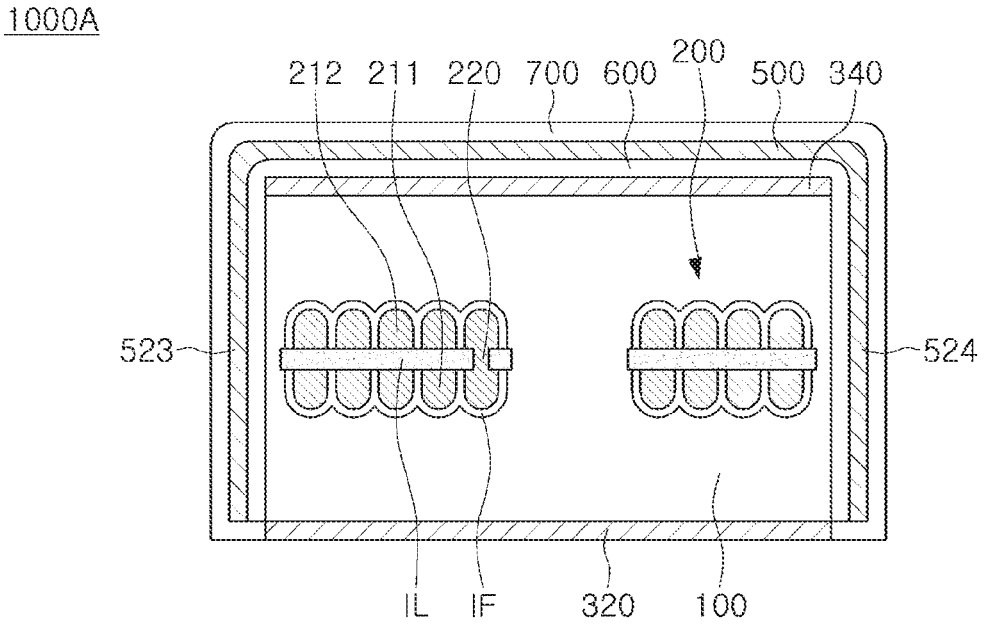
Figure 11A:
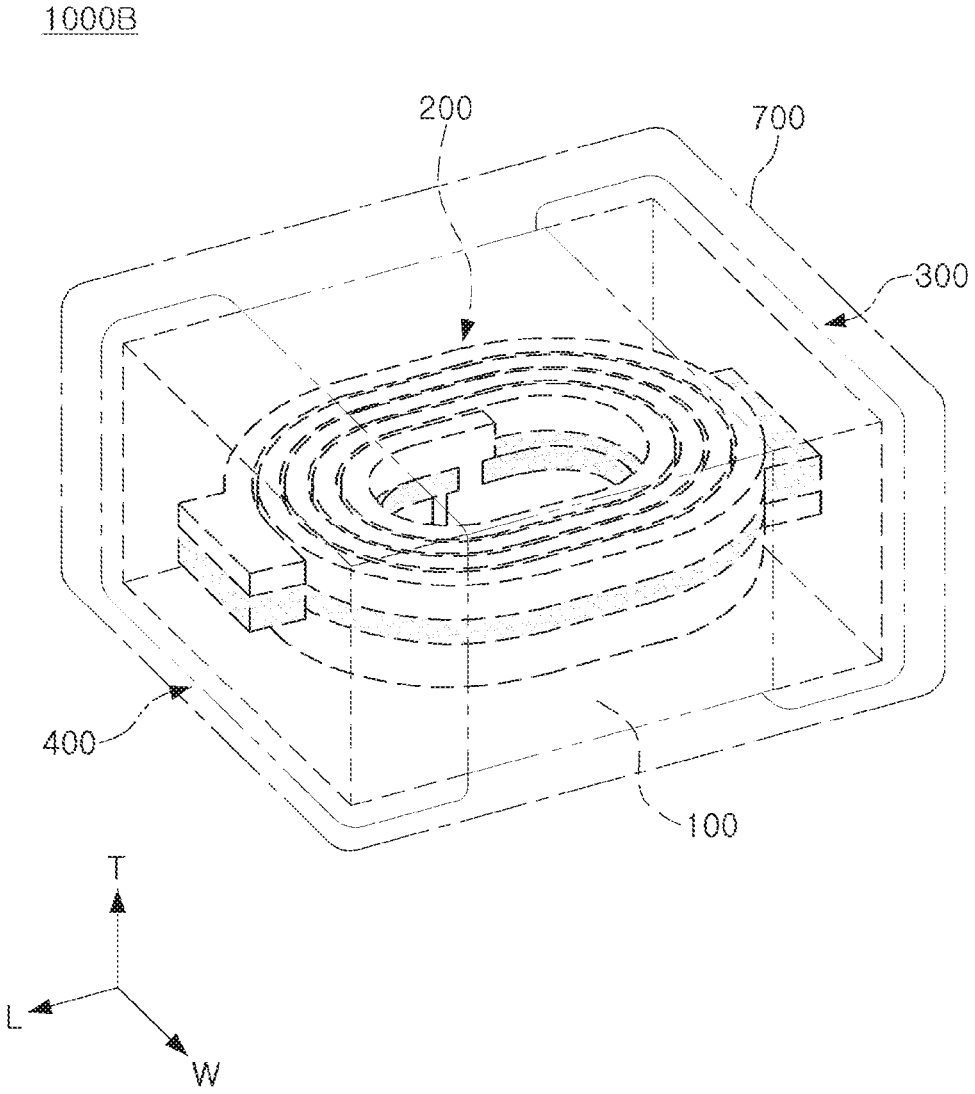
Figure 11B:
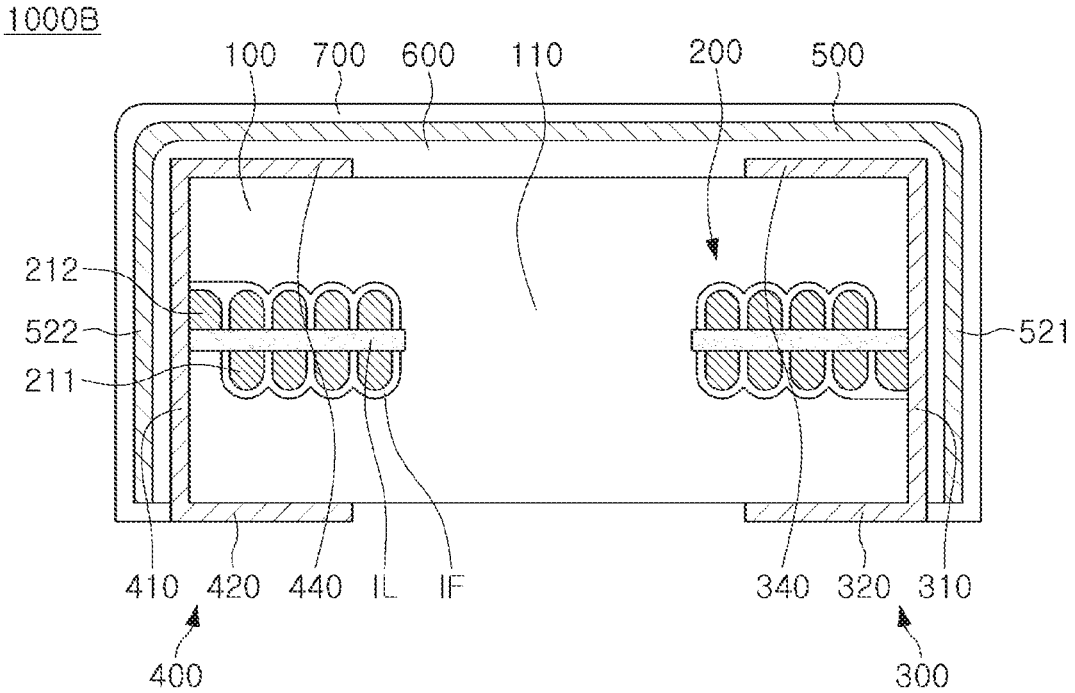
Figure 11C:
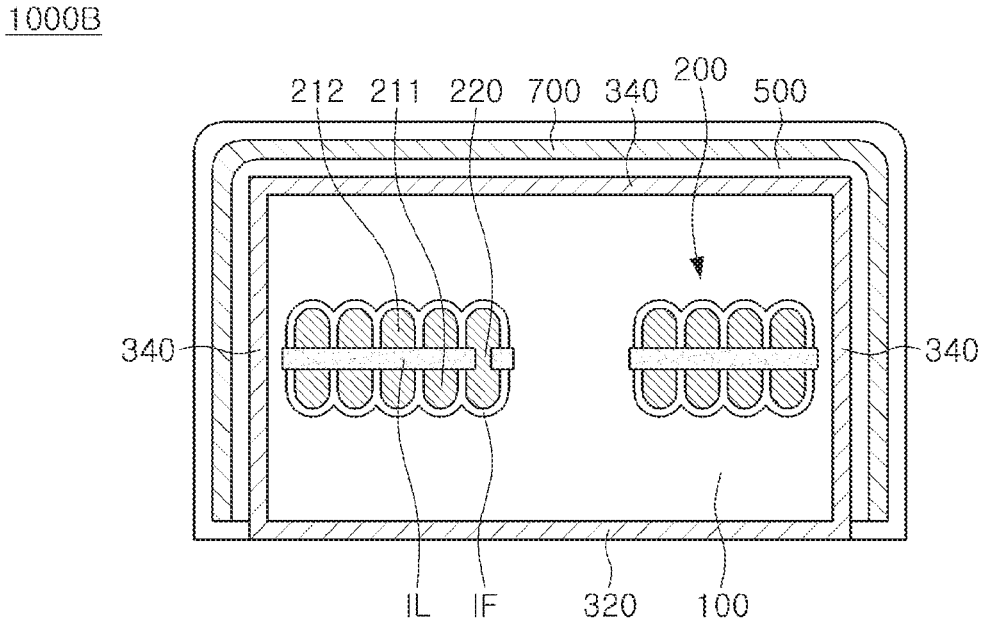
Figure 12:
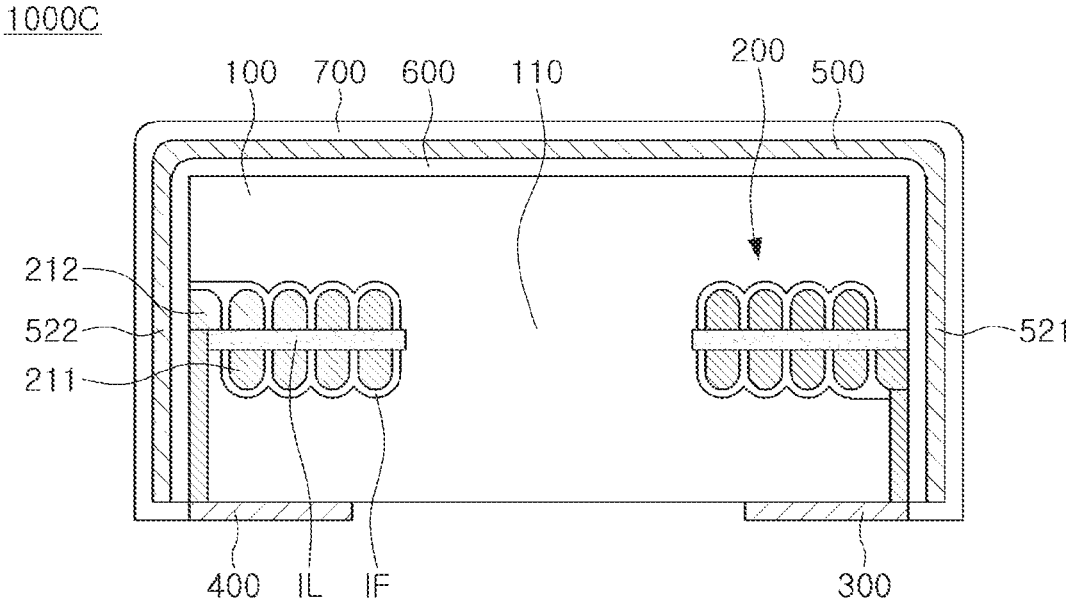

FIGS. 10A through 12 are schematic views illustrating first to third modified examples in the present disclosure. In detail, FIG. 10A is a perspective view illustrating a coil component according to a first modified example, FIG. 10B is a cross-sectional view taken along an LT plane of FIG. 10A, and FIG. 10C is a cross-sectional view taken along a WT plane of FIG. 10A. FIG. 11A is a perspective view illustrating a coil component according to a second modified example, FIG. 11B is a cross-sectional view taken along an LT plane of FIG. 11A, and FIG. 11C is a cross-sectional view taken along a WT plane of FIG. 11A. FIG. 12 is a cross-sectional view illustrating a coil component according to a third modified example and corresponding to the cross-sectional view taken along line I-I' of FIG. 1.

Referring to FIGS. 10A through 12, the coil component according to the present disclosure may have coil components 1000A, 1000B, and 1000C according to first to third modified examples in which shapes of external electrodes are modified.

In detail, referring to FIGS. 10A through 10C, in the coil component 1000A according to the first modified example in the present disclosure, the external electrodes 300 and 400 may further include band portions 340 and 440 extending from the connection portions 310 and 410 to the fifth surface of the body 100, respectively. As an example, a first external electrode 300 may further include a first band portion 340 extending from the first connection portion 310 to the fifth surface of the body 100. That is, in the present modified example, the external electrodes 300 and 400 may be electrodes having a '⊏' shape.

Referring to FIGS. 11A through 11C, in the coil component 1000B according to the second modified example in the present disclosure, the external electrodes 300 and 400 may further include band portions 340 and 440 extending from the connection portions 310 and 410 to the third to fifth surfaces of the body 100, respectively. As an example, a first external electrode 300 may further include a first band portion 340 extending from the first connection portion 310 to the third to fifth surfaces of the body 100. That is, in the present modified example, the external electrodes 300 and 400 may be five-sided electrodes.

Referring to FIG. 12, in the coil component 1000C according to the third modified example in the present disclosure, the external electrodes 300 and 400 may be formed on only the sixth surface of the body 100. In this case, end portions of the first coil pattern 211 and the second coil pattern 212 are not exposed, or are exposed, to the first and second surfaces of the body 100, respectively, but may be exposed to the sixth surface of the body 100 and be connected to the first and second external electrodes 300 and 400, respectively. The end portion of the second coil pattern 212 may penetrate through the internal insulating layer IL and the body 100, and be exposed to the sixth surface of the body 100.

Figure 13:
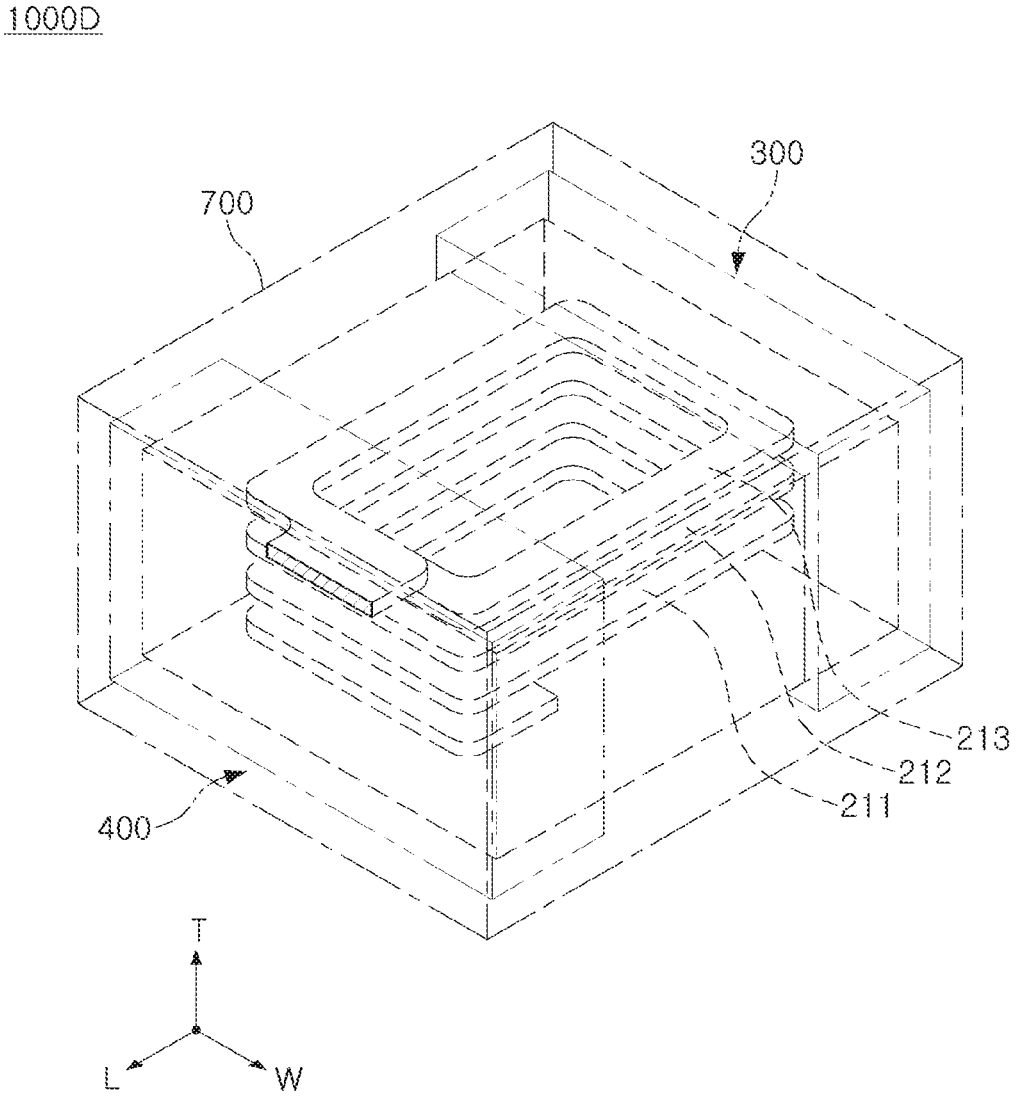

FIG. 13 is a schematic view illustrating a fourth modified example in the present disclosure.

The coil component according to the present disclosure may have a coil component 1000D according to a fourth modified example in which a form of a coil portion 200 is modified.

In detail, referring to FIG. 13, the coil portion 200 according to the present modified example may be formed in a structure in which a plurality of coil patterns 211, 212, and 213 are stacked in the thickness direction (T) of the body. Here, the plurality of coil patterns 211, 212, and 213 may be connected to one another by a connection via (not illustrated) formed in the thickness direction (T) of the body to constitute one coil portion 200.

The coil component 1000D according to present modified example may not include the internal insulating layer and the insulating film of the coil component according to the first exemplary embodiment in the present disclosure.

In the present modified example, the body 100 may be formed by stacking a plurality of magnetic composite sheets to which a conductive paste for forming a coil portion 200 to be described below is applied. In this case, via holes for forming the connection via may be drilled in at least portions of the magnetic composite sheets constituting the body. The via hole may be formed by applying a conductive paste, similar to the coil portion.

Meanwhile, although not illustrated, a coil component having a coil portion formed by sequentially stacking the respective coil patterns formed perpendicular to the sixth surface of the body in the length direction or the width direction of the body may also be included in the modified example in the present disclosure.

In addition, FIGS. 10A through 13 illustrate the coil components 1000A, 1000B, 1000C, and 1000D according to the modified examples in the present disclosure in relation to the first exemplary embodiment in the present disclosure, but the modified examples described above may be similarly applied to the second to seventh exemplary embodiments in the present disclosure.

As set forth above, according to an exemplary embodiment in the present disclosure, a leaked magnetic flux of the coil component may be decreased.

In addition, the leaked magnetic flux of the coil component may be decreased, and characteristics of the coil component may be substantially maintained.

While exemplary embodiments have been shown and described above, it will be apparent to those skilled in the art that modifications and variations could be made without departing from the scope of the present invention as defined by the appended claims.

What is claimed is:

1. A coil component comprising:

a body having one surface and another surface opposing each other in one direction and including magnetic metal powder particles;

a coil portion including a coil pattern having at least one turn around the one direction, and embedded in the body;

an external electrode disposed on the one surface of the body and connected to the coil portion;

a shielding layer disposed on the another surface of the body;

an insulating layer disposed between the body and the shielding layer; and a cover layer disposed on the shielding layer, wherein the cover layer covers an end surface of the shielding layer so as to close the shielding layer together with the insulating layer.

2. The coil component of claim 1, wherein a thickness of the shielding layer is greater in a central portion of the another surface of the body than in an outer side portion of the another surface of the body.

3. The coil component of claim 1, wherein the shielding layer includes:

a cap portion disposed on the another surface of the body; and a sidewall portion connected to the cap portion and disposed on a wall of the body connecting the one surface of the body and the another surface of the body to each other.

4. The coil component of claim 3, wherein the cap portion and the sidewall portion are one integral piece.

5. The coil component of claim 3, wherein a connection portion between the cap portion and the sidewall portion has a curved surface shape.

6. The coil component of claim 3, wherein the cap portion has a thickness greater than that of the sidewall portion.

7. The coil component of claim 3, wherein a number of walls of the body is plural and a number of sidewall portions is plural, and the plurality of sidewall portions are disposed on the plurality of walls of the body, respectively.

8. The coil component of claim 7, wherein the plurality of sidewall portions are one integral piece.

9. The coil component of claim 8, wherein the plurality of sidewall portions and the cap portion are one integral piece.

10. The coil component of claim 7, wherein the plurality of sidewall portions include first and second sidewall portions disposed, respectively, on any one and another of the plurality of walls of the body, each of the first and second sidewall portions has one end connected to the cap portion and another end opposing the one end, and distances from the one surface of the body to the another ends of the first and second sidewall portions are different from each other.

11. The coil component of claim 1, wherein the number of coil patterns is plural, and the plurality of coil patterns are stacked in the one direction and are connected to each other.

12. The coil component of claim 1, further comprising an internal insulating layer, wherein the coil portion includes first and second coil patterns stacked in the one direction and a via connecting the first and second coil patterns to each other, and the internal insulating layer is disposed between the first and second coil patterns, and the via penetrates through the internal insulating layer.

13. The coil component of claim 12, further comprising an insulating film formed along surfaces of the first coil pattern, the internal insulating layer, and the second coil pattern.

14. The coil component of claim 1, wherein the shielding layer includes at least one of a conductor and a magnetic material.

15. The coil component of claim 1, wherein the cover layer extends to the one surface of the body and has an opening, in which a penetration portion of the external electrode is disposed.

16. The coil component of claim 1, wherein a sum of thicknesses of the insulating layer, the shielding layer, and the cover layer is 30 nm or greater and 100 μm or less.

17. The coil component of claim 1, wherein the shielding layer includes:

a first shielding layer disposed on the another surface of the body; and a second shielding layer disposed on the first shielding layer, and the insulating layer includes:

a first insulating layer disposed between the first shielding layer and the body; and a second insulating layer disposed between the first shielding layer and the second shielding layer.

18. The coil component of claim 17, wherein the first shielding layer includes a magnetic material, and the second shielding layer includes a conductor and is disposed on each of a plurality of walls of the body connecting the one surface of the body and the another surface of the body to each other.

19. The coil component of claim 17, wherein the first shielding layer includes a conductor and is disposed on each of a plurality of walls of the body connecting the one surface of the body and the another surface of the body to each other, and the second shielding layer includes a magnetic material.

20. A coil component comprising:

a body having one surface and another surface opposing each other in one direction and a wall connecting the one surface and the another surface to each other, and including magnetic metal powder particles;

a coil portion embedded in the body and including first and second coil patterns stacked in the one direction;

first and second external electrodes disposed on the one surface of the body to be spaced apart from each other and connected to the first and second coil patterns, respectively;

a shielding layer including a cap portion disposed on the another surface of the body and a sidewall portion disposed on the wall of the body;

an external insulating layer disposed between the body and the shielding layer and between the first and second external electrodes and the shielding layer; and a cover layer disposed on the shielding layer to cover the shielding layer and directly connected to the external insulating layer.

21. A coil component comprising:

a body;

a coil portion embedded in the body;

an external electrode disposed on at least a lower surface of the body and connected to the coil portion;

a shielding layer covering at least a portion of the body;

a cover layer covering the shielding layer; and an insulating layer disposed between the body and the shielding layer, wherein a distance between the shielding layer and the external electrode is 10 nm or greater and 100 μm or less, and wherein the shielding layer is sealed by the cover layer and the insulating layer.

22. The coil component of claim 21, wherein the external electrode includes a connection portion disposed between the body and the insulating layer and an extending portion extending from the connection portion disposed on a side surface of the body to the lower surface of the body.

23. The coil component of claim 21, wherein the shielding layer includes a sidewall portion covering a side surface of the body and a cap portion extending from the sidewall portion onto an upper surface of the body opposing the lower surface.

24. The coil component of claim 23, wherein the sidewall portion of the shielding layer has a thickness less than that of the cap portion of the shielding layer.

25. The coil component of claim 23, wherein a central portion of the cap portion of the shielding layer is thicker than an outer portion of the cap portion of the shielding layer.

26. The coil component of claim 23, wherein a thickness of the sidewall portion of the shielding layer increases in a direction from the lower surface to the upper surface of the body.

27. A coil component comprising:

a body having first and second surface opposing each other in a first direction of the body, third and fourth surfaces opposing each other in a second direction of the body and connecting the first and second surfaces to each other, and fifth and sixth surfaces opposing each other in a third direction of the body and connecting the first and second surfaces to each other and the third and fourth surfaces to each other;

a coil portion including a coil pattern having at least one turn around the third direction, and embedded in the body;

an external electrode disposed on the sixth surface of the body and connected to the coil portion;

a shielding layer covering the first to fifth surfaces of the body;

an insulating layer disposed between the body and the shielding layer; and a cover layer covering an end surface of the shielding layer so as to close the shielding layer together with the insulating layer.

* * * * *